US005988640A

United States Patent [19]

Wheeler

[11] Patent Number: 5,988,640

[45] Date of Patent: Nov. 23, 1999

[54] MULTI-DIMENSIONAL STACKING GAME

[76] Inventor: Dewey Edwin Wheeler, 10102 S. Redwood Rd., South Jordan, Utah 84095

[21] Appl. No.: 09/056,246

[22] Filed: Apr. 7, 1998

[51] Int. Cl.[6] ..... A63F 3/00

[52] U.S. Cl. ..... 273/241; 273/290; 273/282.1; 273/153 P

[58] Field of Search ..... 273/290, 241, 273/282.1, 153 P; 434/236

[56] References Cited

U.S. PATENT DOCUMENTS

| | | | |
|---|---|---|---|
| D. 328,475 | 8/1992 | Gould et al. . | |
| 3,784,205 | 1/1974 | Cross, Jr. | 273/241 |
| 3,891,217 | 6/1975 | Geary et al. | 273/290 |
| 4,133,538 | 1/1979 | Ambrose . | |
| 4,173,833 | 11/1979 | Rosenblatt | 434/236 |
| 4,184,685 | 1/1980 | Wilson . | |
| 4,955,615 | 9/1990 | Eck . | |
| 5,560,611 | 10/1996 | Kim | 273/272 |

FOREIGN PATENT DOCUMENTS

| | | | |
|---|---|---|---|
| 3127075 | 1/1983 | Germany | 273/282.1 |
| 2227422 | 8/1990 | United Kingdom | 273/241 |

OTHER PUBLICATIONS (ISBN–0534142869) Gustafson and Frisk, *Functions and Graphs,* Second Edition, Brooks/Cole Publishing Company, CA, 1987, pp. 64–65.

*Primary Examiner*—Benjamin H. Layno

[57] ABSTRACT

A game for two to eight players comprising a game base upon which at least thirty game pieces, with different distinguishing features and values, are placed, and a method for playing the same. The game pieces are stacked upon one another, from the game base, forming planar levels of a three-dimensional structure. The game's concession for a myriad of game base types enable the construction of many diverse structures. The game pieces are identical in size and, preferably, a spherical shape. The game pieces are partitioned, according to their distinguishing features, into a plurality of sets. The method for playing the game comprises: setting up, comprising; separating the game pieces into the sets, distributing the sets to the players, and randomly selecting a player to begin play, playing, comprising; placing the game pieces on the planar levels, placing game pieces on the visible, outer, surface positions of the three-dimensional structure to obtain points, and using optional processes for playing, comprising; a free placement step, an adjacency step, and removal and replacement step, and finally, determining a winner, comprising; tallying the values of the game pieces which are on the visible, outer, surface positions of the three-dimensional structure, and using optional processes for determining a winner, comprising; a multiplication by side step, and a multiplication by planar level step. The player with the greatest quantity of points at the end of the game wins.

21 Claims, 21 Drawing Sheets

MULTI-DIMENSIONAL STACKING GAME

BACKGROUND OF THE INVENTION

1. Field of the Invention

This "Multi-Dimensional Stacking Game" invention relates, in general, to games. More specifically, the present invention relates to multi-dimensional games, of chance and skill, which involve the stacking of games pieces on a game base. Sets of these game pieces have different distinguishing features and operate in relation to one another according to specific rules.

2. Background Information

Many people are intrigued by captivating games. Games stimulate the human mind and provide a means of entertainment for players and spectators. In the past, varied forms of multi-dimensional games have been developed. Each game is unique, has strict rules and guidelines for play, and is often designed for a specific audience. A considerable amount of time and thought is required of an inventor when creating a new game. People who enjoy playing innovative games appreciate the effort put forth to develop them.

Games which use multiple planar playing fields, three-dimensional structures, and successive interlocking levels of play created from the stacking of game pieces, have been patented. These include: U.S. Pat. No. 4,184,685; "Three-Dimensional Game Apparatus" invented by David A. D. J. Wilson of Cleveland, Ohio, U.S. Pat. No. 4,133,538; "Pyramid Building Game" invented by David W. Ambrose of Croton on Hudson, N.Y., and U.S. Pat. No. 4,955,615; "Hexagonal Game Textiles" invented by Brian D. Eck of Oklahoma City, Okla.

The patents evaluated herein are not admitted, by the inventor, to be "prior art" with respect to the present invention. A review of these patents is only necessary to clearly establish the uniqueness and individualism of this Multi-Dimensional Stacking Game. The scope of this new invention, including its features, objects, and claims is novel.

The "Three-Dimensional Game Apparatus" (U.S. Pat. No. 4,184,685), invented by David A. D. J. Wilson of Cleveland, Ohio, is a multi-dimensional game. Mr. Wilson provides a game with two planar playing fields that are parallel to one another and connected by a center support member. Spherically shaped game pieces are also provided. The object of Mr. Wilson's game is to move game pieces through the opponent's area into a home area, beginning on one level and ending on the other. The player which moves all game pieces into the corresponding home area first wins the game.

The Multi-Dimensional Stacking Game differs from the game of Mr. Wilson in many ways. Unlike Mr. Wilson's game, no support structure, separate from a game base and at least thirty game pieces, is required for play of the game. The edifice of this new game is constructed entirely from the stacking of game pieces, upon a game base, during play of the game. This is an advantage to players because no pre-assembly of a complicated structure is required to play the game. As in games like Mr. Wilson's, assembly can be frustrating and time consuming. Also, parts required for assembly can be lost or broken.

The "Pyramid Building Game" (U.S. Pat. No. 4,133,538), invented by David W. Ambrose of Croton on Hudson, N.Y., is a multi-dimensional pyramid building game. Mr. Ambrose provides a game wherein each player uses a separate set of building blocks that interlock during play to form individual polyhedron structures. Each polyhedron structure assembled during the game is a regular pyramid having a square base. During the game, players compete to be the first to finish building their individual polyhedron structure.

The Multi-Dimensional Stacking Game differs from the game invented by Mr. Ambrose. In Mr. Ambrose's game multiple game boards are provided upon which separate pyramid structures are constructed. The Multi-Dimensional Stacking Game provides one game base upon which all players contribute to assemble a single three-dimensional edifice. When players compete on a single structure the challenge of the game is more enriched because they directly interact with each other. The placement of a game piece by one player directly affects the placement of a game piece by another. Direct interaction among the players makes the game more fun.

The completion of the structure of this Multi-Dimensional Stacking Game, may signify the end of the game, but does not itself determine the winner. Understanding this is important because, unlike Mr. Ambrose's game, an object of this new game is to win by obtaining points through the proper placement of game pieces on the structure, not the completion of the structure itself. T he anticipated completion of the edifice plus additional objects of the game makes this new game more entertaining than other multi-dimensional games.

The shapes of Mr. Ambrose's game pieces limit the structural composition of his game apparatus to a regular pyramid having a square base. The Multi-Dimensional Stacking Game is not limited to the structural composition of a regular pyramid having a square base. The design of its game pieces and the game's concession for a myriad of game base types enable the construction of many diverse structures.

The "Hexagonal Game Textiles" (U.S. Pat. No. 4,955,615), invented by Brian D. Eck of Oklahoma City, Okla., are hexagonally shaped game pieces developed for a three-dimensional stacking game. Mr. Eck provides a game which uses game pieces of hexagonal shape that interlock to form successive levels of play. During his game players position their game pieces to exert maximum influence over other game pieces.

The Multi-Dimensional Stacking Game also uses game pieces that interlock to form successive levels of play. These game pieces are not hexagonally shaped, but interlock when a single game piece is placed above, and tangent to, at least the four game pieces below it. Along with its unique method of forming successive levels of play the specific rules of this new game differentiate it from Brian D. Eck's game.

The Multi-Dimensional Stacking Game disclosed herein is novel. The combination of its game apparatus and methodology of play clearly distinguishes it from all other games, including the game inventions discussed above. No game of chance or strategy, is known, which incorporates the relationship between game pieces, that have different distinguishing features, with the construction of a captivating three-dimensional structure. The multidimensional game domain, along with its concepts and rules of play, makes this new Multi-Dimensional Stacking Game one-of-a-kind.

SUMMARY OF THE INVENTION

Accordingly, it is an object of the present invention to provide a game of chance and skill in which no support structure, separate from a game base and at least thirty game pieces, is required for play of the game.

Another object of the present invention is to provide a game having a sound three-dimensional structure formed from the stacking of game pieces during a process for playing the game.

Another object of the present invention is to provide a game in which all players contribute to build a single predetermined three-dimensional stricture.

Yet another object of the present invention is to provide a game wherein players win by obtaining points through the proper placement of game pieces on a three-dimensional structure.

Still another object of the present invention is to provide a game wherein players anticipate the completion of a three-dimensional structure.

A further object of the present invention is to provide a game in which supplemental processes for playing the game and supplemental processes for determining a winner can be incorporated into a basic methodology for playing the game.

Still, a further object of the present invention is to provide a game in which supplemental processes for playing the game and supplemental processes for determining a winner can be combined, in various ways, and incorporated into a basic methodology for playing the game.

Briefly, this Multi-Dimensional Stacking Game invention is a three-dimensional game for two to eight players comprising: a game base, at least thirty game pieces, at least four planar levels, a plurality of containers, and a unique methodology for playing the game.

The game base is the center of game play. The mechanics of the game are set in motion from this foundation. It is the main structure on which all game pieces are placed. The game base is comprised of a top plane, a bottom plane, a plurality of side planes, and at least sixteen primary means for holding a game piece. The bottom plane is parallel to the top plane. The plurality of side planes connect the top plane to the bottom plane. Each primary means for holding a game piece is in communication with the top plane.

The arrangement of the primary means for holding a game piece, in communication with the top plane of the game base, forms a grid. The grid is defined by a "Cartesian coordinate system" which uses integers on its x-axis number line and y-axis number line to specify its coordinates. The distance between each integer on the x-axis number line and y-axis number line is identical. Within the grid, the center of each primary means for holding a game piece is located at a coordinate point.

Within the grid, each primary means for holding a game piece is part of an uninterrupted sequence of at least four primary means for holding a game piece, each having the same x-coordinate with successive y-coordinates. Also, each primary means for holding a game piece is part of an uninterrupted sequence of at least four primary means for holding a game piece, each having successive x-coordinates with the same y-coordinate.

Within the grid, each primary means for holding a game piece is pall of a group. Each group consists of four primary means for holding a game piece, positioned in the shape of a square. Within the group, each primary means for holding a game piece is adjacent to two primary means for holding a game piece wherein one of the adjacent primary means for holding a game piece has the same x-coordinate with a successive y-coordiniate and the other has a successive x-coordinate with the same y-coordinate.

Furthermore, each primary means for holding a game piece is distant from the primary means for holding a game piece to which it is adjacent, such that the game piece which is held by it does not obstruct the game piece which is held by the primary means for holding a game piece to which it is adjacent. Also, each primary means for holding a game piece is near to the primary means for holding a game piece to which it is adjacent such that when each primary means for holding a game piece of the group is holding a game piece simultaneously, the four said game pieces collectively create a secondary means for holding a game piece. This secondary means for holding a game piece supports a game piece in a manner that positions it above the top plane of the game base and centered above, and tangent to, at least the four said game pieces that support it.

Within the grid, each group is positioned adjacent to between two and four other groups, such that within each group two of its primary means for holding a game piece, which are adjacent, are members of the adjacent group. The grid is the sum of the adjacent groups.

There are at least thirty game pieces provided with this game invention. Enough game pieces are provided to entirely build a three-dimensional structure with no vacant primary means for holding a game piece and no vacant secondary means for holding a game piece.

The game pieces are all identical in size and shape. The size and shape enables each game piece to be held by each primary means for holding a game piece and each secondary means for holding a game piece.

The game pieces are partitioned into a plurality of sets at least equal to the number of players playing the game and no greater than ten. Each game piece is a member of a set. Tile quotient, from the game pieces divided by the plurality of sets, defines the quantity ot game pieces that are in each set. Any game pieces remaining from said division of game pieces are members of a remainder set.

The quotient, from the plurality of sets divided by the quantity of players, defines the quantity of sets, other than a free placement set, that each player primarily Controls throughout the game. Any sets remaining from said division of sets are members of the free placement set.

The quotient, from the quantity of game pieces of the free placement set divided by the quantity of players, defines the quantity of game pieces of the free placement set that each player primarily controls throughout the game. Any game pieces remaining from said division of game pieces of the free placement set are members of the remainder set.

Each game piece is comprised of at least one distinguishing feature. Each game piece of a set has the same distinguishing feature. Each game piece of a set has a distinguishing feature that is different from the game pieces the other sets. The distinguishing feature enables players to rapidly differentiate the game pieces of one set with the game pieces of the other sets.

Each game piece, other than the game pieces of the remainder set and the free placement set, has a point value. This point value is identical for all game pieces of a set. The point value is determined by the order of distribution of the set to the player during the process for setting up the game, wherein:

Each game piece of the first set distributed to the player has a point value. This point value is identical for each game piece of all first sets distributed to the players.

Each game piece of the second set distributed to the player has a point value from three to five times greater than the point value of each game piece of the first set distributed to the player. This point value is identical for each game piece of all second sets distributed to the players.

Each game piece of the third set distributed to the player has a point value from two to three times greater than the point value of each game piece of the second set distributed to the player. This point value is identical for each game piece of all third sets distributed to the players.

Each game piece of each additional set, greater than the third set, distributed to the player is two times greater than the point value of each game piece of the previous set distributed to the player.

At least four planar levels are formed from the stacking of game pieces throughout the game. A planar level is the sum of the game pieces, supported by the primary means for holding a game piece or the secondary means for holding a game piece, within the same horizontal plane parallel to the top plane of the game base. Each planar level builds upon the planar level below it.

The "Cartesian coordinate system" is also used to specify the coordinates of the secondary means for holding a game piece within each planar level above the planar level tangent to the top plane of the game base. The use of the "Cartesian coordinate system," within a planar level, is independent from all other planar levels.

The game is comprised of a plurality of containers equal to the number of sets distributed to the players. Each container is large enough to contain all of the game pieces of a set.

The methodology for playing the game is unique. It utilizes the game apparatus that has hereto been summarized. After providing the game apparatus to the players the methodology for playing the game begins with a process for setting up the game followed by a process for playing the game concluded with a process for determining a winner.

The process for setting up the game is comprised of the following steps:

The game pieces are collected together into the plurality of sets.

Each set, other than the remainder set, is placed into a separate container. When free placement sets are available, the free placement set primarily controlled by each player is placed into a separate container.

The sets are then distributed to the players. Each player receives one set at a time, rotating among all of the players, until all of the sets are distributed. Each player receives one free placement set, when they are available.

Players are positioned clockwise around the game base. These positions are sequential according to the order of distribution of the first set distributed to the players.

The remainder set is placed in the primary means for holding a game piece most centrally located within the grid. The placement of the remainder set must be away from the visible, outer, surface of the three-dimensional structure.

The process for playing the game is comprised of the following steps:

One of the game pieces of the sets, other than the remainder set and the free placement set, is randomly selected.

The player who primarily controls the game piece of the set selected begins play of the game by taking a turn, comprising;

When free placement sets have been distributed to the players during the process for setting Lip the game, each player has the option of placing a game piece of the flee placement set at the beginning of the turn. The option of placing a game piece of the free placement set may only be applied when free placement sets have been distributed to the players during the process for setting up the game. When a game piece of the free placement set is placed another game piece, of the free placement set, or of the set or sets other than the free placement set, must be placed in the same turn. When a game piece, of the set or sets other than the free placement set, is placed, the turn ends. This placement cycle continues until either there are no more game pieces of the free placement set or the player chooses to place a game piece of the set or sets other than the flee placement set. When the last game piece of the free placement set has been placed a game piece of the other set or sets primarily controlled by the player must be placed, if one is available. The player's turn then ends.

Or, placing a game piece of the set or sets primarily controlled by the player in any vacant primary means for holding a game piece or any vacant secondary means for holding a game piece.

After the beginning player has completed the first turn, play continues to the next player.

Players take turns placing game pieces on the forming three-dimensional structure. These turns rotate clockwise throughout the entire game.

Players obtain points through the placement of game pieces on the visible, outer, surface of the three-dimensional structure.

Play continues until all game pieces that can be placed are placed, and, if possible, the three-dimensional structure is completed.

At the end of the game, when there are no more game pieces to be placed, the process for determining a winner, comprised of the following steps, is applied:

Points are tallied by adding up the values of the game pieces on the visible, outer, surface of the three-dimensional structure.

The player with the greatest quantity of points from the tally wins the game. If the quantity of points earned by a player is equal to the quantity of points earned by another player the game is a tie.

Supplemental processes for playing the game and supplemental processes for determining a winner may be incorporated into the methodology for playing the game that has hereto been summarized. These include:

An adjacency step, which is supplemental to the process for playing the game, wherein:

When the plurality of sets, excluding the free placement set, is greater than four, the game piece of a set, excluding the game piece of the free placement set, may not be placed in the primary means for holding a game piece or the secondary means for holding a game piece, of the same planar level, which has the same x-coordinate plus or minus one integer with a y-coordinate plus or minus one integer, as the primary means for holding a game piece or the secondary means for holding a game piece which is holding the game piece of a set primarily controlled by another player when the sequential order of distribution, during the process for setting up the game, of the set to which the game piece being placed is a member of is identical to the set to which the game piece limiting the placement of said game piece being placed is a member.

In the event that a player is unable to place a game piece, due to the adjacency step, the player's turn is skipped until the player can comply with the adjacency step.

When none of the players are able to place a game piece, due to the adjacency step. play of the game ends. During the process for determining a winner two times the value of any remaining game piece is deducted from the player primarily controlling said game piece.;

Alternately, an adjacency step, which is supplemental to the process for playing the game, wherein: When the plurality of sets, excluding the free placement set, is greater than four, the game piece of a set, excluding the game piece of the free placement set, may not be placed in the primary means for holding a game piece or the secondary means for holding a game piece, of the same planar level, which has the same x-coordinate with a y-coordinate plus or minus one integer, or which has an x-coordinate plus or minus one integer with the same y-coordinate, as the primary means for holding a game piece or the secondary means for holding a game piece which is holding the game piece of a set primarily controlled by another player when the sequential order of distribution, during the process for setting up the game, of the set to which the game piece being placed is a member of is identical to the set to which the game piece limiting the placement of said game piece being placed is a member.

In the event that a player is unable to place a game piece, due to said adjacency step, the player's turn is skipped until the player can comply with said adjacency step.

When none of the players are able to place a game piece, due to said adjacency step, play of the game ends. During the process for determining a winner two times the value of any remaining game piece is deducted from the player primarily controlling said game piece.;

A removal and replacement step, which is supplemental to the process for playing the game, wherein: When the plurality of sets, excluding the free placement set, is greater than two, players have the option of removing a game piece, primarily controlled by another player, from the three-dimensional structure and then placing it in any vacant primary means for holding a game piece or any vacant secondary means for holding a game piece of the planar levels when the sequential order of distribution, during the process for setting up the game, of the set to which the game piece being removed is a member of is identical to the set which predetermines the removal of the game piece.

A game piece of the set which predetermines the removal of the game piece must be available for placement.

After the game piece has been removed and placed, a game piece of the set, which predetermined the removal of said game piece, is replaced to the primary means for holding a game piece or the secondary means for holding a game piece from which said game piece was removed.

When the player chooses to apply the removal and replacement step the flee placement step is disregarded.;

Alternately, a removal and replacement step, which is supplemental to the process for playing the game, wherein: When the plurality of sets, excluding the free placement set, is greater than two, players have the option of removing a game piece, primarily controlled by another player, from the three-dimensional structure and then placing it in any vacant primary means for holding a game piece or any vacant secondary means for holding a game piece of the planar levels when the sequential order of distribution, during the process for setting up the game, of the set to which the game piece being removed is a member of is opposite to the set which predetermines the removal of the game piece.

A game piece of the set which predetermines the removal of the game piece must be available for placement.

After the game piece has been removed and placed, a game piece of the set, which predetermined the removal of said game piece, is replaced to the primary means for holding a game piece or the secondary means for holding a game piece from which said game piece was removed.

When the player chooses to apply the removal and replacement step the free placement step is disregarded.;

A multiplication by sides step, which is supplemental to the process for determining a winner, wherein; before points are tallied, the quantity of sides of the three-dimensional structure with which the game piece is in communication is multiplied by the point value of said game piece.;

A multiplication by planar level step, which is supplemental to the process for determining a winner, wherein; before points are tallied, the point value of the game piece is multiplied by the planar level with which said game piece resides.

The aforementioned objects, features, and advantages of this Multi-Dimensional Stacking Game invention will, in part, be pointed out with particularity and will, in part. become obvious from the following more detailed description of the invention, taken in conjunction with the accompanying drawings, which form an integral part thereof.

REFERENCE NUMERALS IN THE DRAWINGS

10—game base
20—three-dimensional structure
30—top plane
40—bottom plane
50—side plane
60—angular plane
70—primary means for holding a game piece
70*a*—primary means for holding a game piece
70*b*—primary means for holding a game piece
80—grid
90—"Cartesian coordinate system"
100—integers
110—x-axis number line
120—y-axis number line
130—coordinate point
140—group
150—game piece
150*a*—game piece
150*b*—game piece
150*c*—game piece
160—length A
170—length B
180—clear plastic
190—secondary means for holding a game piece
200—natural rubber
210—white
220—red
230—green
240—black
250—blue
260—brown
270—yellow
280—purple
290—orange
300—planar level
310—bag
320—void

DETAILED DESCRIPTION OF THE INVENTION

Figure 1:
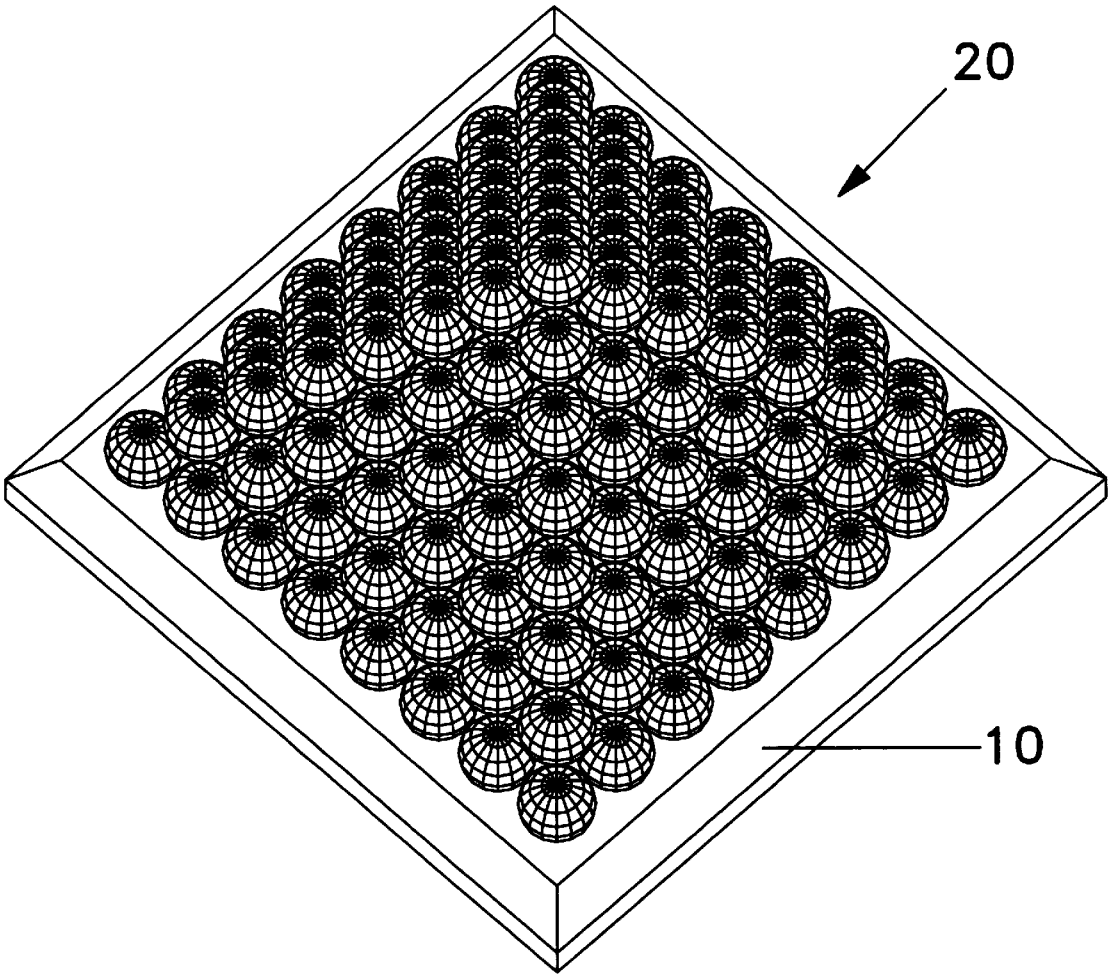
FIG. 1 is an isometric view of the most preferred embodiment of the apparatus for playing the game.

Refer now to FIG. 1 of the patent drawings, which is an isometric view of the most preferred embodiment of the apparatus for playing the game. At the end of the game the final three-dimensional structure 20 will appear in the general form of a pyramid. The three-dimensional structure 20 is formed from the stacking of game pieces 150 throughout the game.

Figure 2:
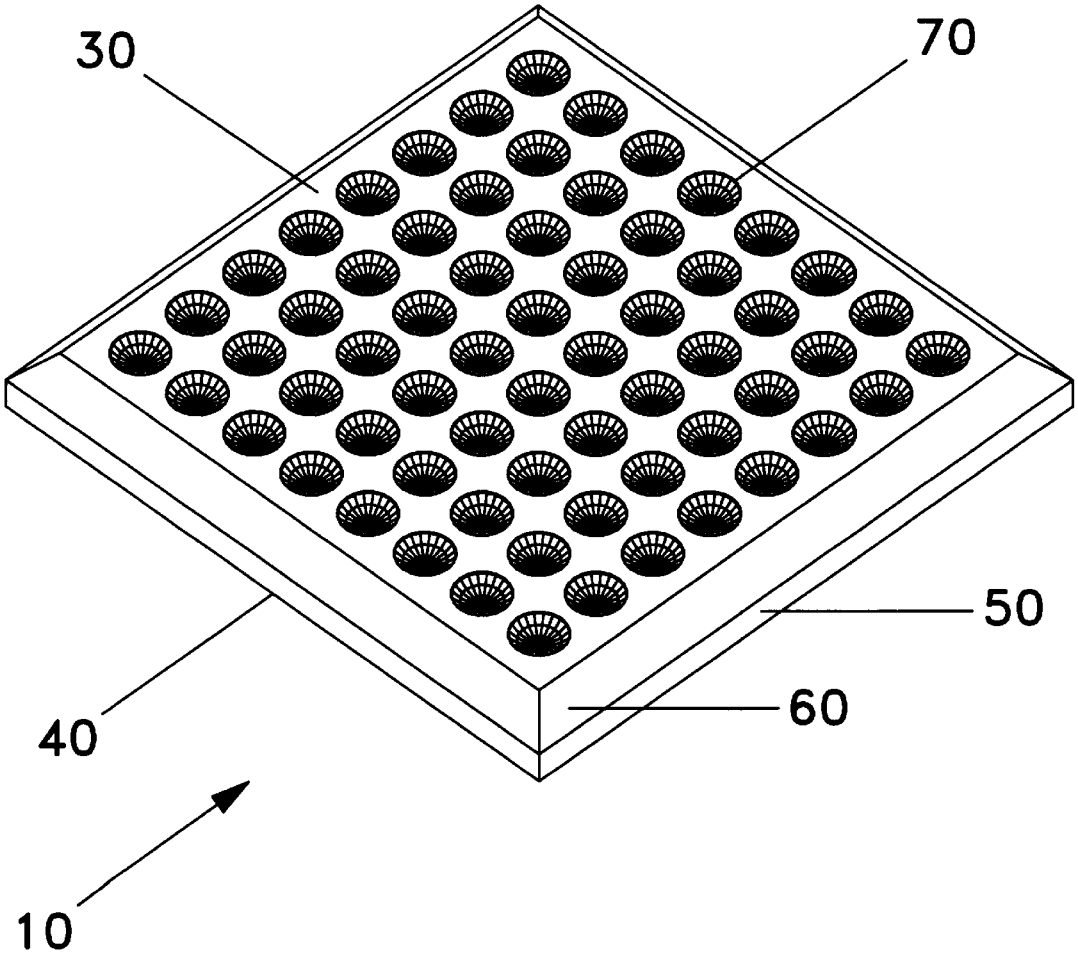
FIG. 2 is an isometric view of the most preferred embodiment of the game base.

The most preferred embodiment of the game base 10, is shown in FIG. 2. The game base 10 is comprised of a top plane 30, a bottom plane 40, a plurality of side planes; such as four side planes 50, a plurality of angular planes; such as four angular planes 60, and at least sixteen primary means for holding a game piece; such as sixty four primary means for holding a game piece 70. The bottom plane 40 is parallel to the top plane 30. Each said angular plane 60 is angular to the top plane 30 and to each said side plane 50. The plurality of angular planes 60 are in communication with the top plane 30 and the plurality of side planes 50. Said top plane 30, said bottom plane 40, and said plurality of side planes 50 are each in the form of a parallelogram. Said plurality of angular planes 60 are each in the form of a trapezoid. Each said primary means for holding a piece 70 is in communication with the top plane 30. Each said primary means for holding a game piece 70 is comprised of a hemispherically shaped cavity recessed into said game base 10.

Figure 3:
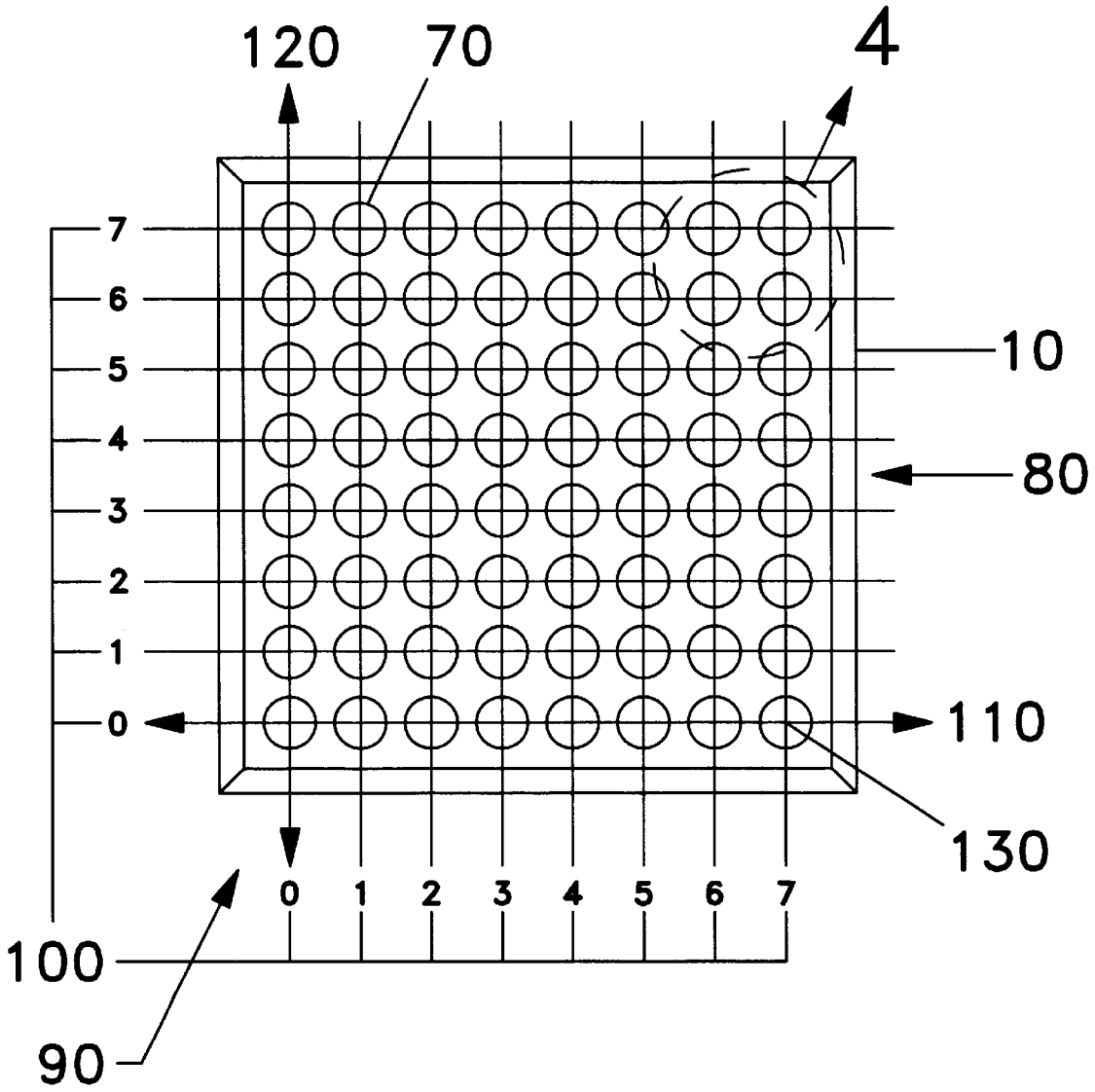
FIG. 3 is a plan view of the most preferred embodiment of the game base.

FIG. 3, which is a plan view of the most preferred embodiment of the game base 10, shows that the arrangement of the primary means for holding a game piece 70, in communication with the top plane 30, forms a grid 80. The grid 80 is defined by a "Cartesian coordinate system" 90 (ISBN 0534142869, Gustafson and Frisk, *Functions and Graphs*, Second Edition, Brooks/Cole Publishing Company, CA, 1987, page 64–65) which uses integers 100 on the x-axis number line 110 and the y-axis number line 120 to specify the coordinates within the "Cartesian coordinate system" 90. The integers 100 used in FIG. 3 are for descriptive purposes only, other integers may be used in place of said integers 100. The distance between each said integer 100 on the x-axis number line 110 and the y-axis number line 120 is identical. Within the grid 80, the center of each said primary means for holding a game piece 70 is located at a coordinate point 130.

Within the grid 80, each said primary means for holding a game piece 70 is part of an uninterrupted sequence of at least four said primary means for holding a game piece 70; such as eight said primary means for holding a game piece 70, wherein; each said primary means for holding a game piece 70 has the same x-coordinate, also the primary means for holding a game piece 70 have successive y-coordinates.

Furthermore, within the grid 80, each said primary means for holding a game piece 70 is part of an uninterrupted sequence of at least four said primary means for holding a game piece 70; such as eight said primary means for holding a game piece 70, wherein; the primary means for holding a game piece 70 have successive x-coordinates, also each said primary means for holding a game piece 70 has the same y-coordinate.

Figure 4:
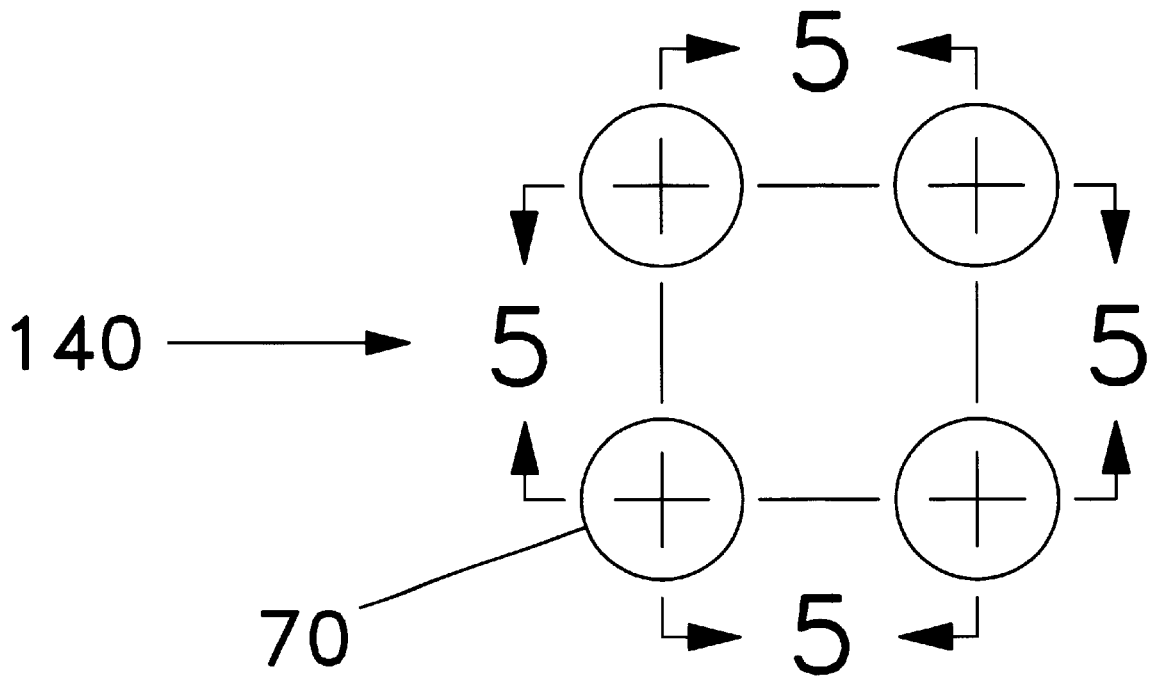
FIG. 4 is a partial view of the most preferred embodiment of the game base illustrating a group.

FIG. 4, a partial view of the most preferred embodiment of the game base 10, shows that within the grid 80, each said primary means for holding a game piece 70 is pail of a group 140. Each said group 140 consists of four said primary means for holding a game piece 70, positioned in the shape of a square. Within the group 140, each said primary means for holding a game piece 70 is adjacent to two primary means for holding a game piece 70 wherein one of the adjacent primary means for holding a game piece 70 has the same x-coordinate with a successive y-coordinate and the other adjacent primary means for holding a game piece 70 has a successive x-coordinate with the same y-coordinate as said primary means for holding a game piece 70.

Figure 5:
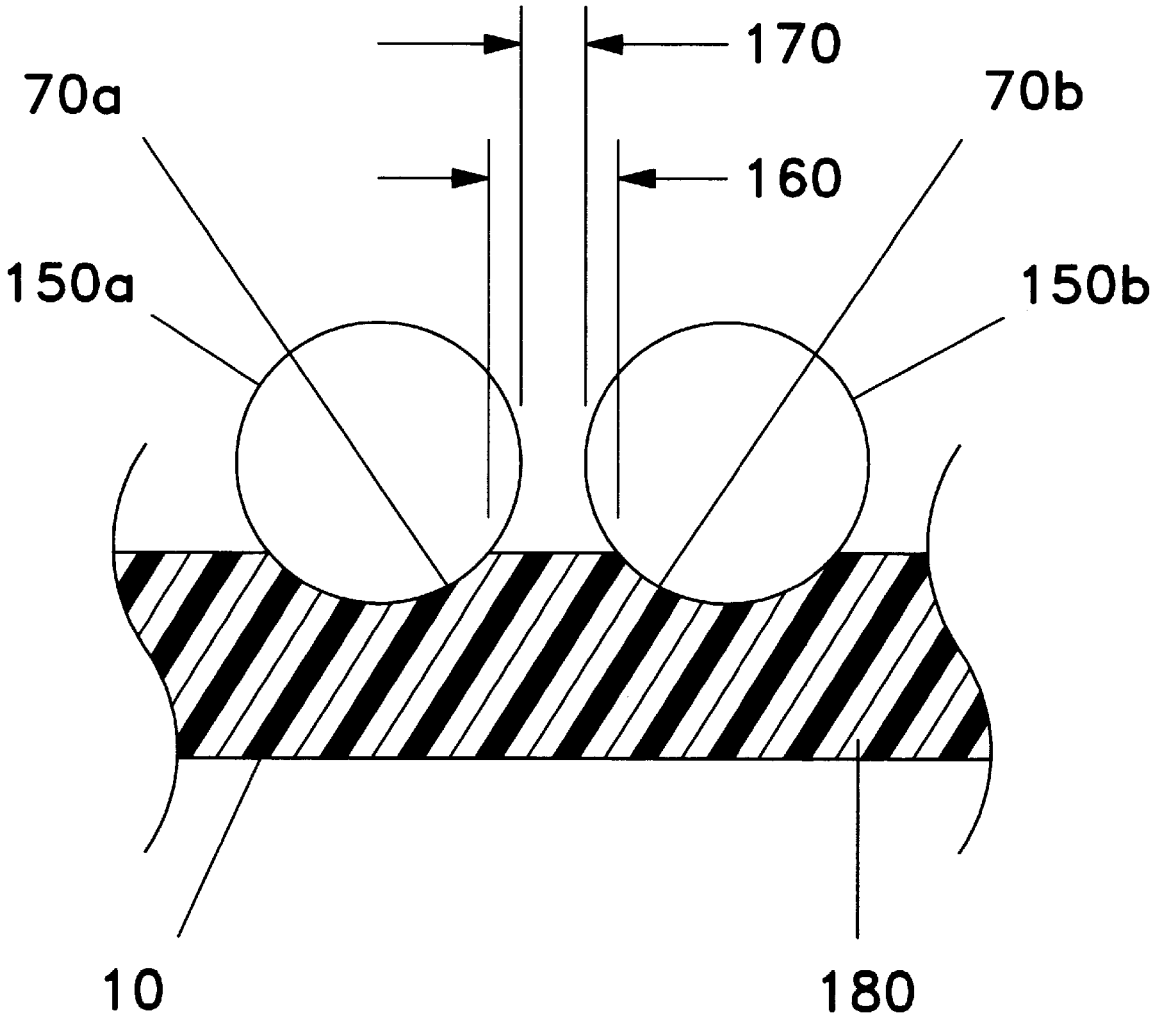
FIG. 5 is a section view of the most preferred embodiment of the game base further illustrating a group, including: game pieces held by the most preferred embodiment of the primary means for holding a game piece.
Figure 6:
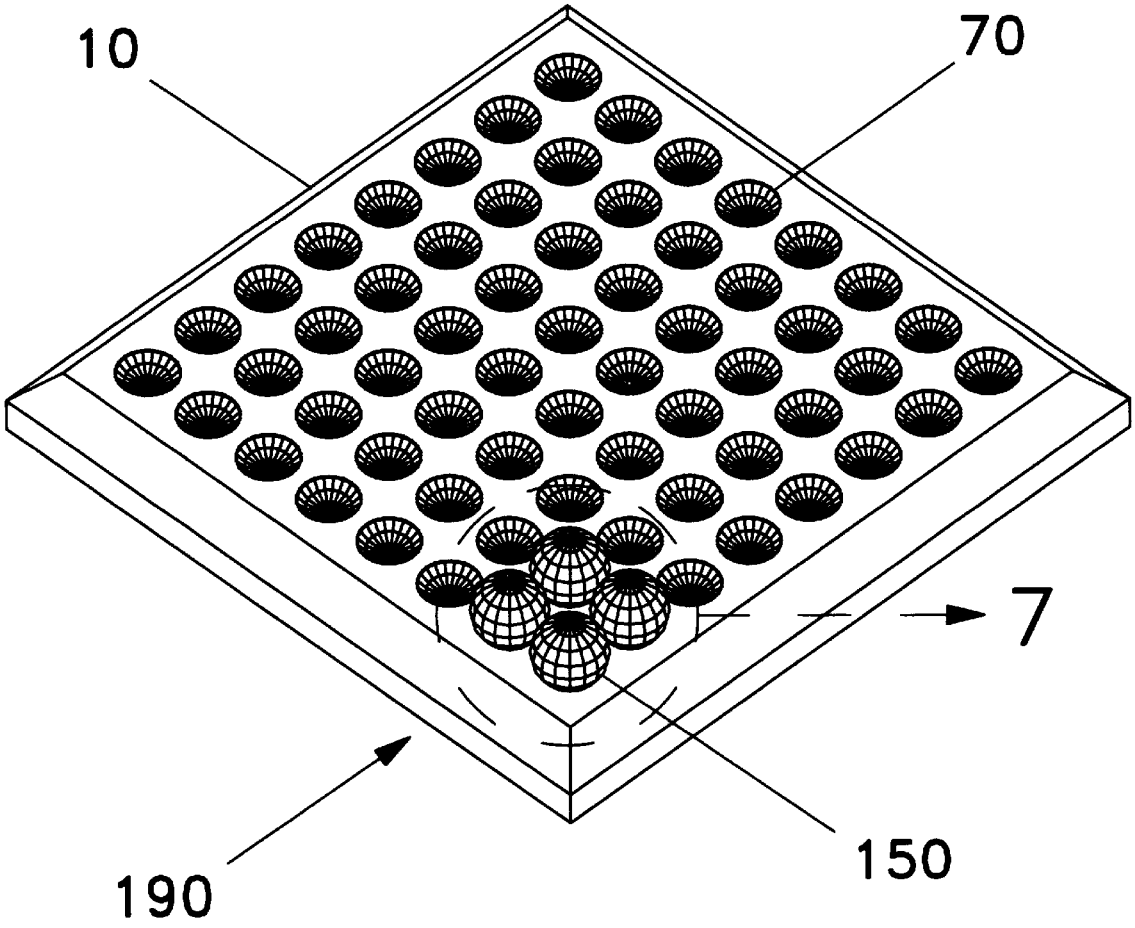
FIG. 6 is an isometric view of the most preferred embodiment of the secondary means for holding a game piece on the most preferred embodiment of the game base.
Figure 8:
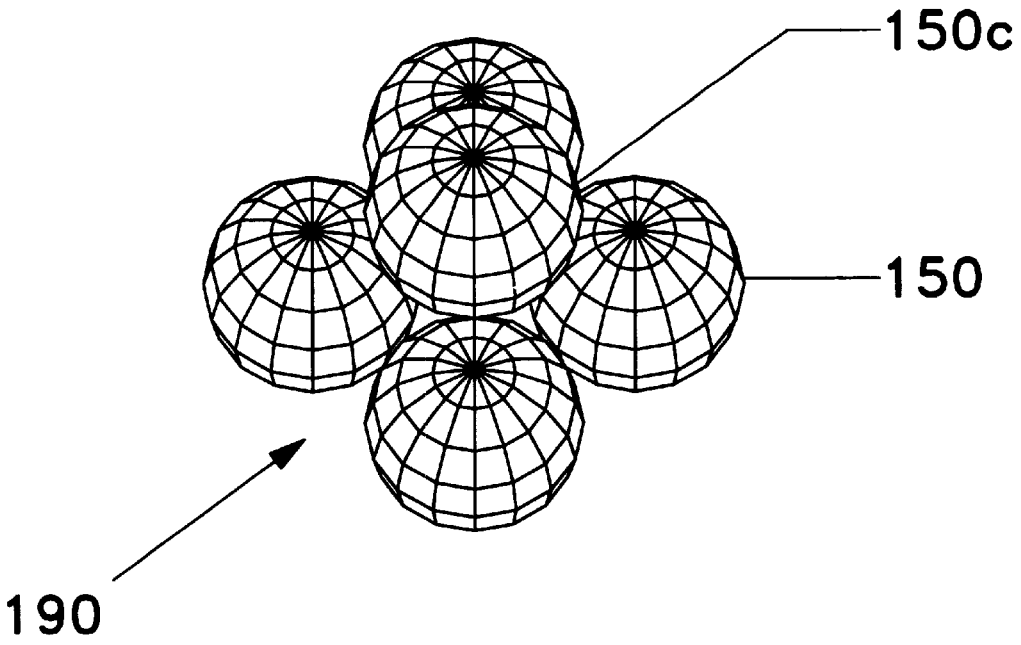
FIG. 8 is an isometric view of the most preferred embodiment of the secondary means for holding a game piece, as shown in the partial isometric view of FIG. 7, shown holding a game piece.
Figure 7:
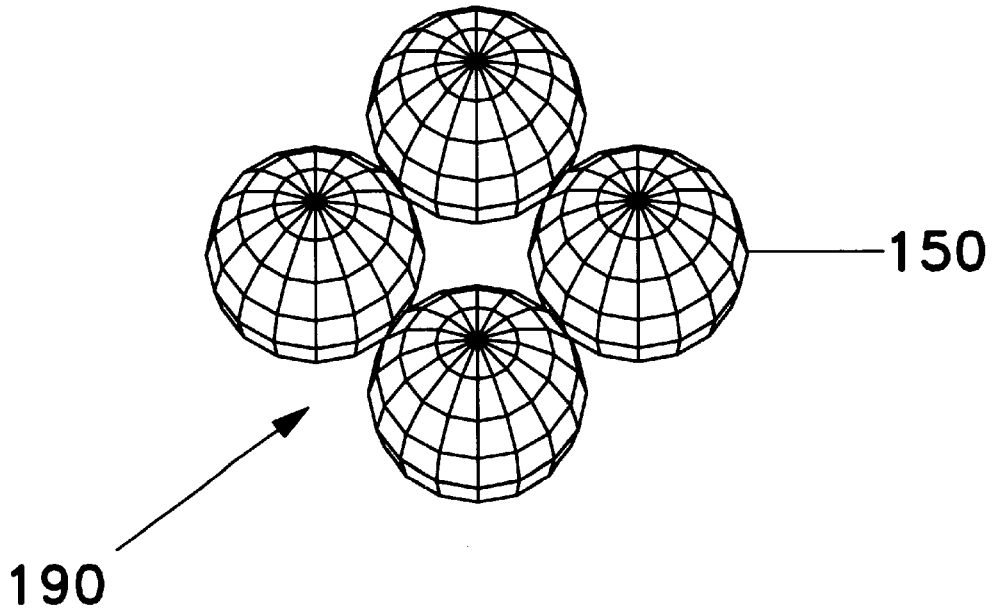
FIG. 7 is a partial isometric view of the most preferred embodiment of the secondary means for holding a game piece.

Furthermore, as FIG. 5 (a section view of the most preferred embodiment of the game base further illustrating said group of FIG. 4, including: two said game pieces 150) demonstrates, each said primary means for holding a game piece 70*a* is distant; such as length A 160, from the primary means for holding a game piece 70*b* to which said primary means for holding a game piece 70*a* is adjacent, such that the game piece 150*a*, which is held by said primary means for holding a game piece 70*a*, does not obstruct; such as length B 170, the game piece 150*b*, which is held by the primary means for holding a game piece 70*b* to which said primary means for holding a game piece 70*a* is adjacent. Also, each said primary means for holding a game piece 70*a* is near; such as length A 160, to the primary means for holding a game piece 70*b* to which said primary means for holding a game piece 70*a* is adjacent, such that when each primary means for holding a game piece 70 of the group 140 is holding a game piece 150 simultaneously, the four said game pieces 150 collectively create a secondary means for holding a game piece 190 (as shown in FIG. 6 and FIG. 7). As shown in FIG. 8, the secondary means for holding a game piece 190 supports a game piece 150*c* in a manner that positions the game piece 150*c* above the top plane 30 of the game base 10 and centered above and tangent to, at least the four said game pieces 150 that support said game piece 150*c*.

Within the grid 80, each said group 140 is positioned adjacent to between two and four other said groups 140, such that within each said group 140, two said primary means for holding a game piece 70, which are adjacent, are members of the adjacent said group 140. The grid 80 is the sum of the adjacent said groups 140.

FIG. 5 also shows that the most preferred embodiment of the game base 10 is manufactured from clear plastic 180.

Figure 9:
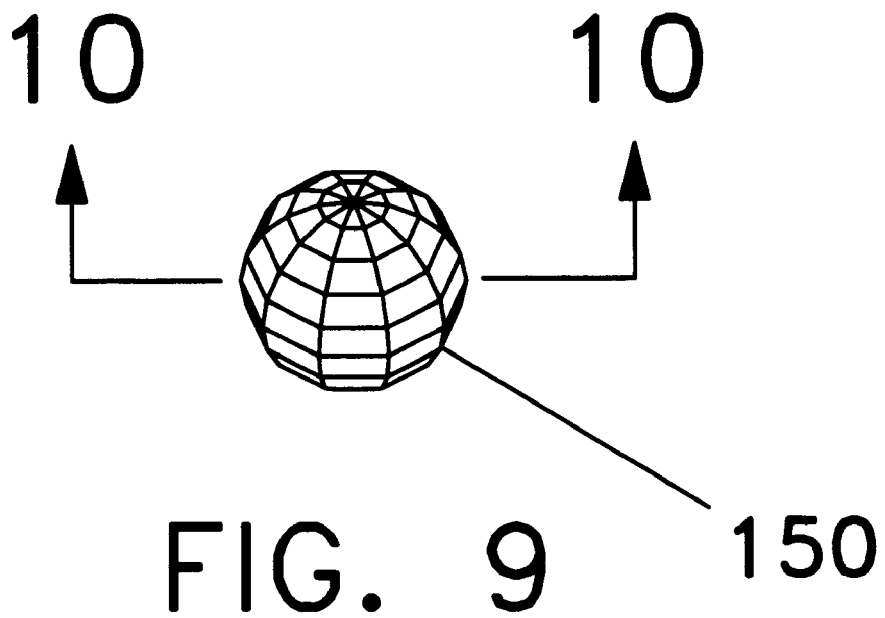
FIG. 9 is an isometric view of the most preferred embodiment of the game piece.
Figure 10:
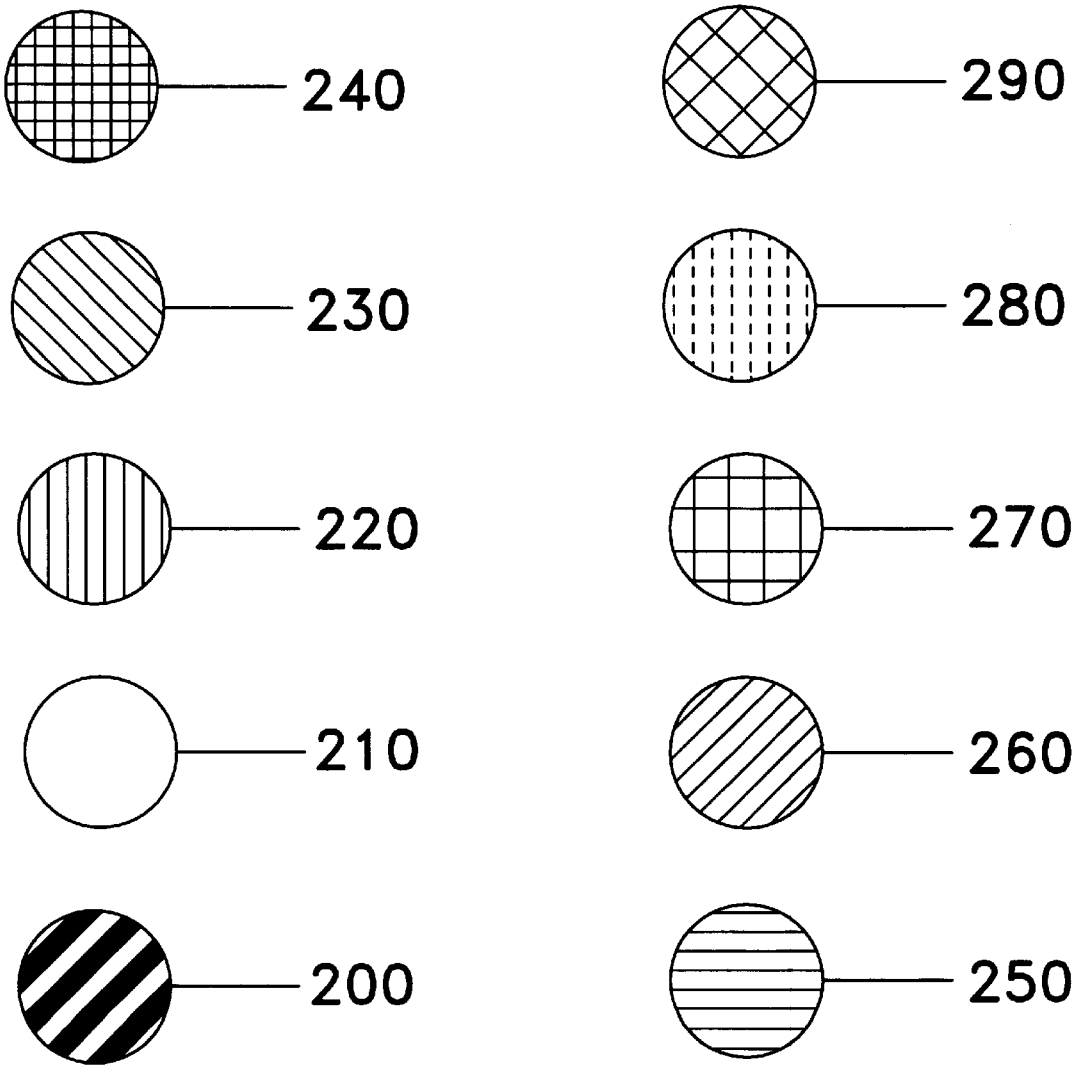
FIG. 10 shows multiple section views illustrating the material and various colors used of the most preferred embodiment of the game piece.

FIG. 9 is an isometric view of the most preferred embodiment of the game piece 150. The shape of the most preferred embodiment of the game piece 150 is comprised of a sphere. The most preferred embodiment of the game piece 150 is manufactured from natural rubber 200, as shown in FIG. 10. The game is comprised of at least thirty game pieces; such as two hundred and four game pieces 150. Enough said game pieces 150 are provided to entirely build the three-dimensional structure 20, with no vacant said primary means for holding a game piece 70 and no vacant said secondary means for holding a game piece 190.

The game pieces 150 are all identical in size and shape. The size and shape enables each said game piece 150 to be held by each said primary means for holding a game piece 70 and each said secondary means for holding a game piece 190.

The game pieces 150 are partitioned into a plurality of sets. The plurality of sets is at least equal to the number of players playing the game and no greater than ten. Each said game piece 150 is a member of a set. The quotient, from the game pieces 150 divided by the plurality of sets, defines the quantity of said game pieces 150 that are in each said set. Any said game pieces 150 remaining from said division are members of a remainder set.

The quotient, from the plurality of sets divided by the quantity of players playing the game, defines the quantity of said sets, other than a free placement set that each player primarily controls throughout the game. Any said sets remaining from said division are members of the free placement set.

The quotient, from the quantity of said game pieces 150 of the free placement set divided by the quantity of players, defines the quantity of said game pieces 150 of the free placement set that each player primarily controls throughout the game. Any said game pieces 150 remaining from said division are members of the remainder set.

Each said game piece 150 is comprised of at least one distinguishing feature; such as a color. Each said game piece 150 of a set has the same said distinguishing feature. Each said game piece 150 of a set has a distinguishing feature that is different from the game pieces 150 of the other said sets. The distinguishing feature enables players to rapidly differentiate the game pieces 150 of one said set with the game pieces 150 of the other said sets. In the most preferred embodiment of the game piece 150, and corresponding with the number of sets that are used, the colors used as distinguishing features are white 210, red 220, green 230, black 240, blue 250, brown 260, yellow 270, purple 280, and orange 290, as shown in FIG. 10.

In the most preferred embodiment of the apparatus for playing the game:

When there are two, three, or six players playing the game there are two hundred and four said game pieces 150 partitioned into six said sets; each said set containing thirty four said game pieces 150. When there are four players playing the game there are two hundred and four said game pieces 150 partitioned into five said sets; four said sets, each said set containing thirty four said game pieces 150 and one said free placement set containing sixty eight said game pieces 150. When there are five players playing the game there are two hundred and four said game pieces 150 partitioned into seven said sets; five said sets, each said set containing thirty four said game pieces 150, one said free placement set containing thirty said game pieces 150, and one said remainder set containing four said game pieces 150. When there are seven players playing the game there are two hundred and four said game pieces 150 partitioned into eight said sets, seven said sets, each said set containing twenty nine said game pieces 150 and one said remainder set containing one said game piece 150. When there are eight players playing the game there are two hundred and four said game pieces 150 partitioned into nine said sets; eight said sets, each said set containing twenty five said game pieces 150 and one said remainder set containing four said game pieces 150.

Each said game piece 150, other than the game pieces 150 of the remainder set and the free placement set, has a point value. The point value is identical for all said game pieces 150 of a set. The point value is determined by the order of distribution of the set to the player during the process for setting up the game, wherein:

Each said game piece 150 of the first said set distributed to the player has a point value; said point value is identical for each said game piece 150 of all first said sets distributed to the players. Each said game piece 150 of the second said set distributed to the player has a point value from three to five times greater than the point value of each said game piece 150 of the first said set distributed to the player; said point value is identical for each said game piece 150 of all second said sets distributed to the players. Each said game piece 150 of the third said set distributed to the player has a point value from two to three times greater than the point value of each said game piece 150 of the second said set distributed to the player; said point value is identical for each said game piece 150 of all third said sets distributed to the players. The point value of each said game piece 150 of each additional said set, greater than the third said set, distributed to the player is two times greater than the point value of each said game piece 150 of the previous said set distributed to the player.

Figure 11:
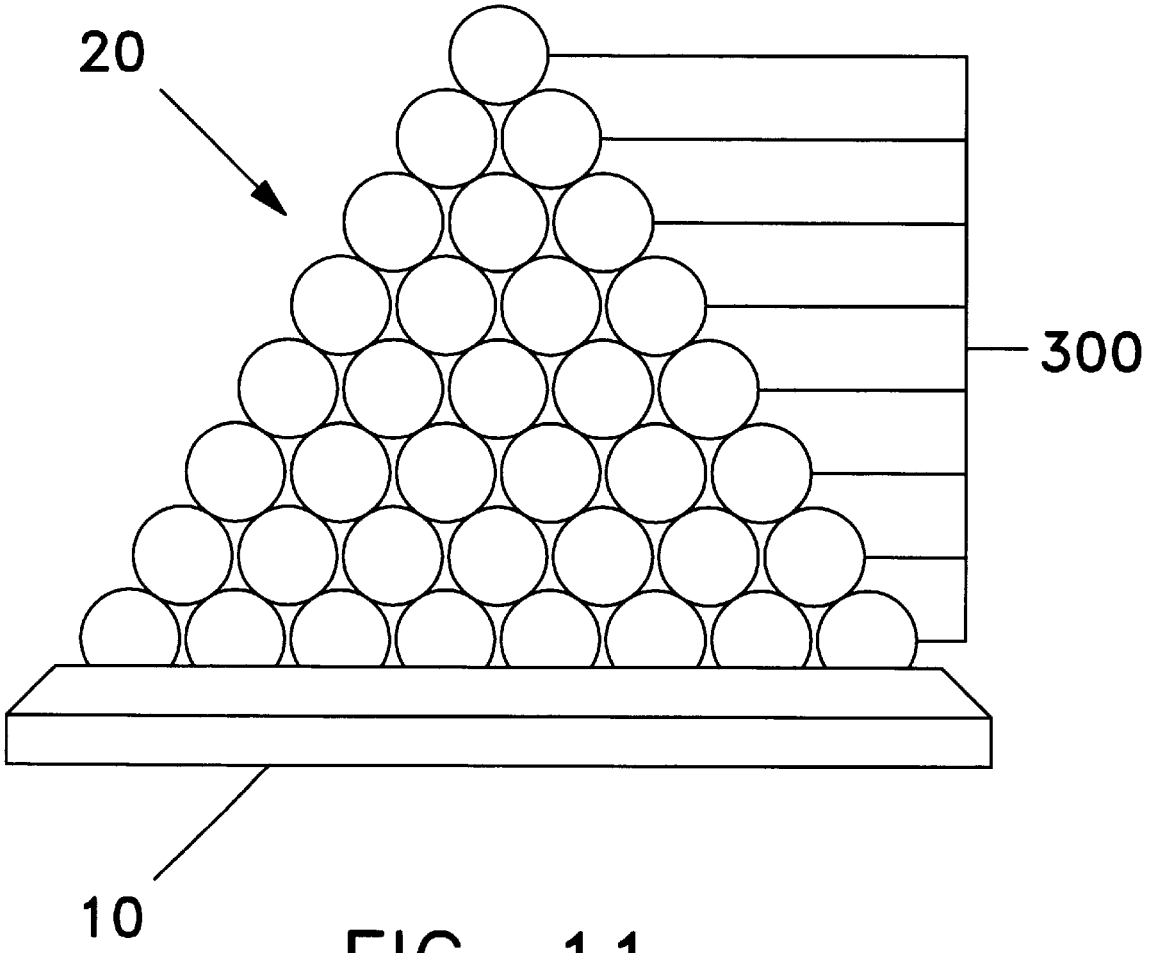
FIG. 11 is a schematic elevation view of the most preferred embodiment of the three-dimensional structure showing the planar levels.

FIG. 11 is a schematic elevation view of the most preferred embodiment of the three-dimensional structure 20. At least four planar levels; such as eight planar levels 300, are formed from the stacking of said game pieces 150 throughout the game. A planar level 300 is the sum of the game pieces 150, supported by the primary means for holding a game piece 70 or the secondary means for holding a game piece 190, within the same horizontal plane parallel to the top plane 30 of the game base 10. Each said planar level 300 builds upon the planar level below said planar level 300. The "Cartesian coordinate system" 90 is used to specify the coordinates of the secondary means for holding a game piece 190 within each said planar level 300 above the planar level 300 tangent to the top plane 30 of the game base 10. The use of the "Cartesian coordinate system" 90, within a planar level 300, is independent from all other said planar levels 300.

Figure 12:
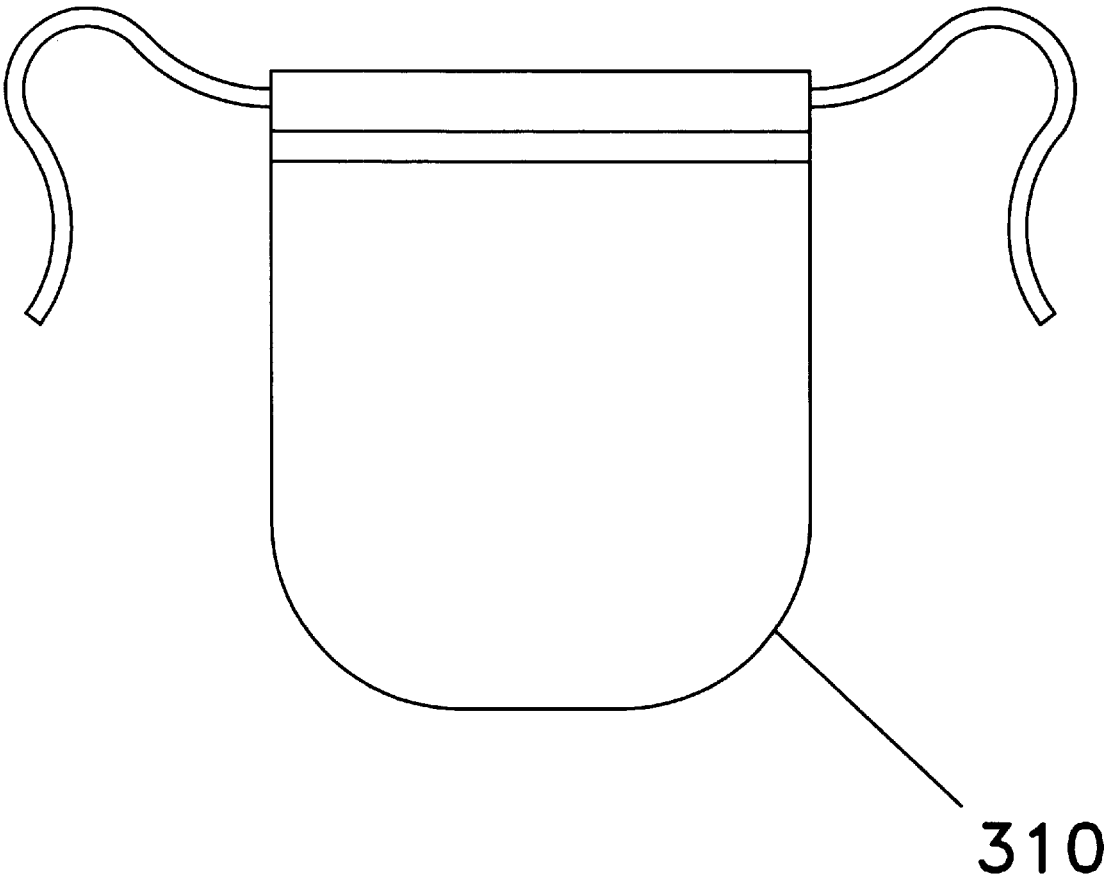
FIG. 12 is a side view of the most preferred embodiment of the container.

The apparatus for playing the game is comprised of a plurality of containers; such as a plurality of bags 310, as shown in FIG. 12. The plurality of bags 310 is equal to the number of said sets distributed to the players. Each bag 310 is large enough to contain all of the game pieces 150 of a set.

After providing said apparatus for playing the game, that has hereto been summarized, the most preferred embodiment of the methodology for playing the game begins with a process for setting up the game followed by a process for playing the game concluded with a process for determining a winner.

The process for setting up the game is comprised of the following steps:

The game pieces 150 are collected together into the plurality of sets.

Each said set, other than the remainder set, is placed into a separate bag 310. When the free placement sets are available, the free placement set primarily controlled by each player is placed into a separate bag 310.

The sets are then distributed to the players. Each player receives said one set at a time, rotating among all of the players, until all said sets are distributed. Each player receives one said free placement set, when they are available.

Players are positioned clockwise around the game base 10. These positions are sequential according to the order of distribution of the first said set distributed to the players.

Figure 13:
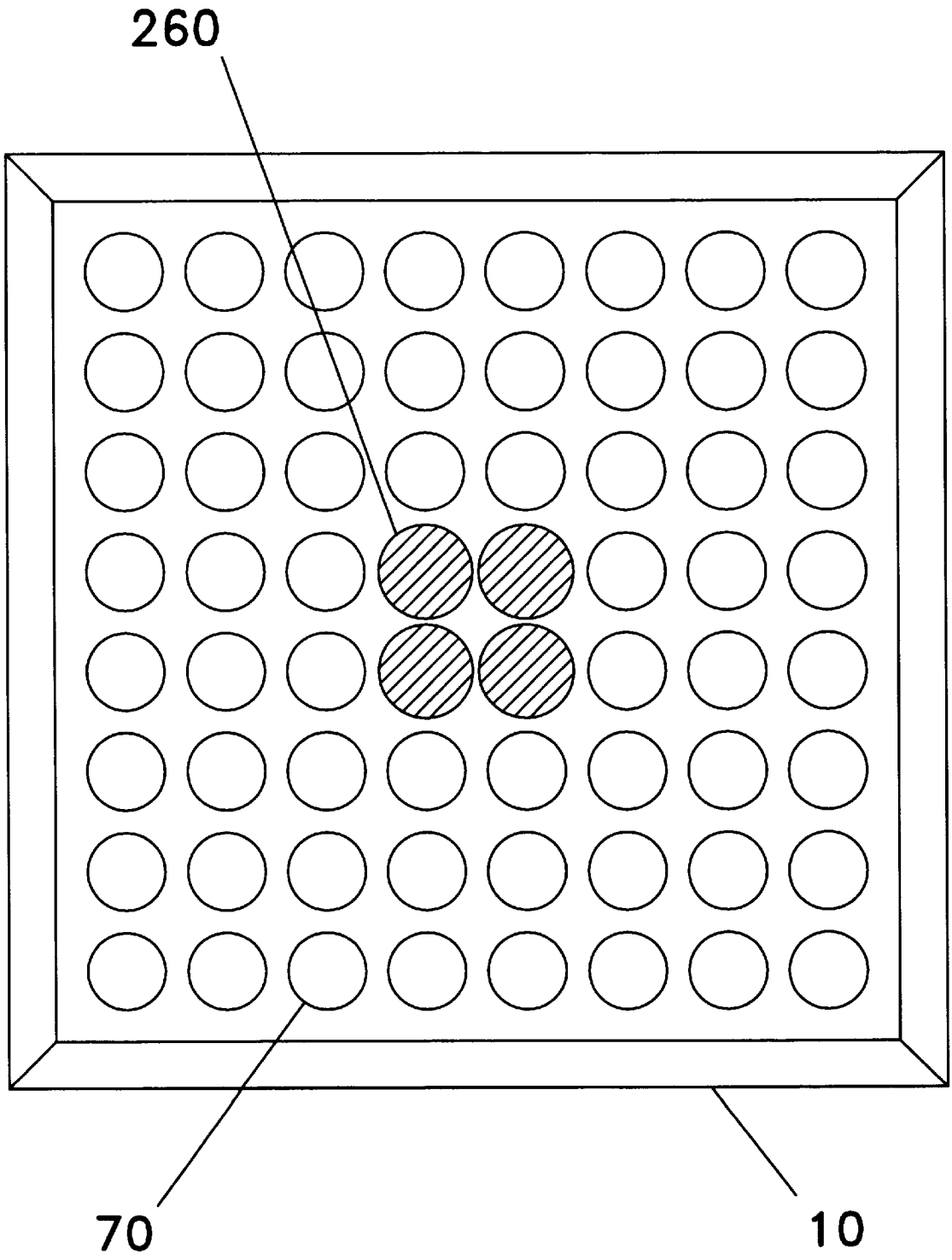
FIG. 13 is a plan view of the most preferred embodiment of the game base illustrating, in schematic, the placement of the remainder set.

The remainder set is placed in the primary means for holding a game piece 70 most centrally located within the grid 80. The placement of the remainder set must be away from the visible, outer, surface of the three-dimensional structure 20. As demonstrated in FIG. 13, the game pieces 150 of the color brown 260, which are members of the remainder set for this demonstration, are placed centrally within the grid 80 and away from the visible, outer, surface of the three-dimensional structure 20.

The process for playing the game is comprised of the following steps:

One of the game pieces 150 of the sets, other than the remainder set and the free placement set, is randomly selected.

The player who primarily controls the game piece 150 of the set selected begins play of the game by taking a turn, comprising;

When said free placement sets have been distributed to the players during the process for setting up the game, each player has the option of placing a game piece 150 of the free placement set at the beginning of the turn. The option of placing a game piece 150 of the free placement set may only be applied when said free placement sets have been distributed to the players during the process for setting up the game. When a game piece 150 of the free placement set is placed another game piece 150, of the free placement set, or of the set or sets other than the free placement set, must be placed in the same turn. When a game piece 150, of the set or sets other than the free placement set, is placed, the turn ends. This placement cycle continues until either there are no more game pieces 150 of the free placement set or the player chooses to place a game piece 150 of the set or sets other than the free placement set. When the last game piece 150 of the free placement set has been placed a game piece 150 of the other said set or sets primarily controlled by the player must be placed, if one is available. The players turn then ends.

Or, placing a game piece 150 of the set or sets, primarily controlled by said player in any vacant said primary means for holding a game piece 70 or any vacant said secondary means for holding a game piece 190.

After the beginning player has completed the first turn, play continues to the next player.

Players take turns placing game pieces 150 on the forming three-dimensional structure 20. These turns rotate clockwise throughout the entire game.

Players obtain points through the placement of game pieces 150 on the visible, outer, surface of the three-dimensional structure 20.

Play continues until all said game pieces 150 that can be placed are placed, and, if possible, the three-dimensional structure 20 is completed. Play of the game then ends.

Figure 14:
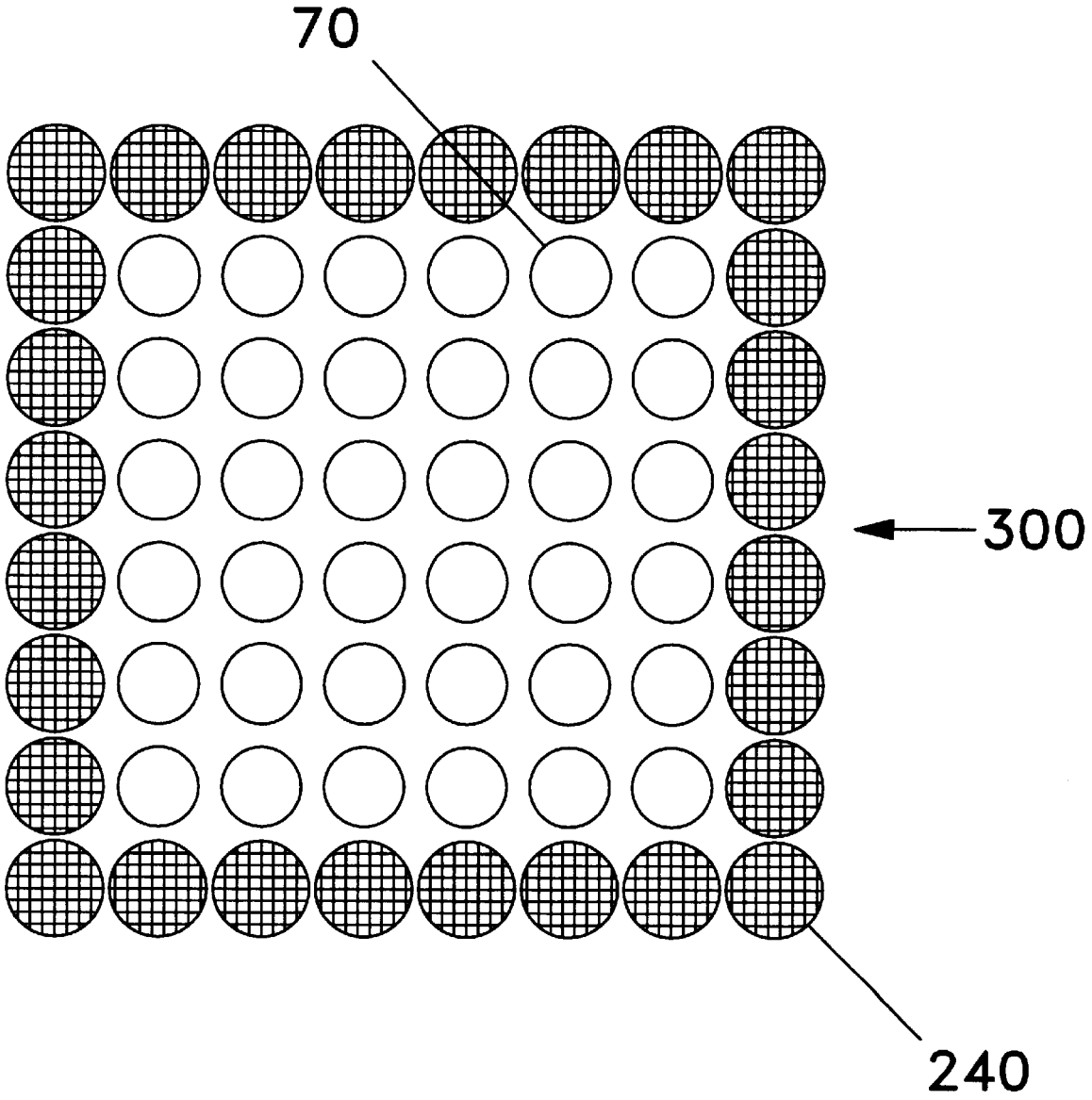
FIG. 14 is a schematic plan view of a planar level.

At the end of the game, when there are no more game pieces 150 to be placed, the process for determining a winner, comprised of the following steps, is applied:

Points are tallied by adding up the values of the game pieces 150 on the visible, outer, surface of the three-dimensional structure 20. FIG. 14, a schematic plan view of the planar level 300 in communication with the top plane 30 of the game base 10, illustrates the visible, outer, surface positions of the three-dimensional structure 20. In this illustration, the game pieces 150 of the color black 240 show the visible, outer, surface positions of the three-dimensional structure 20 of the planar level 300 in communication with the top plane 30 of the game base 10. Each remaining said planar level 300, thought not illustrated in the patent drawings, have corresponding surface positions.

The player with the greatest quantity of points from the tally wins the game. If the quantity of points earned by a player is equal to the quantity of points earned by another player the game is a tie.

Alternate embodiments of the apparatus for playing the game may be used.

In an alternate embodiment of the game base 10 the plurality of side planes; such as four side planes 50, connect the top plane 30 to the bottom plane 40.

Figure 15:
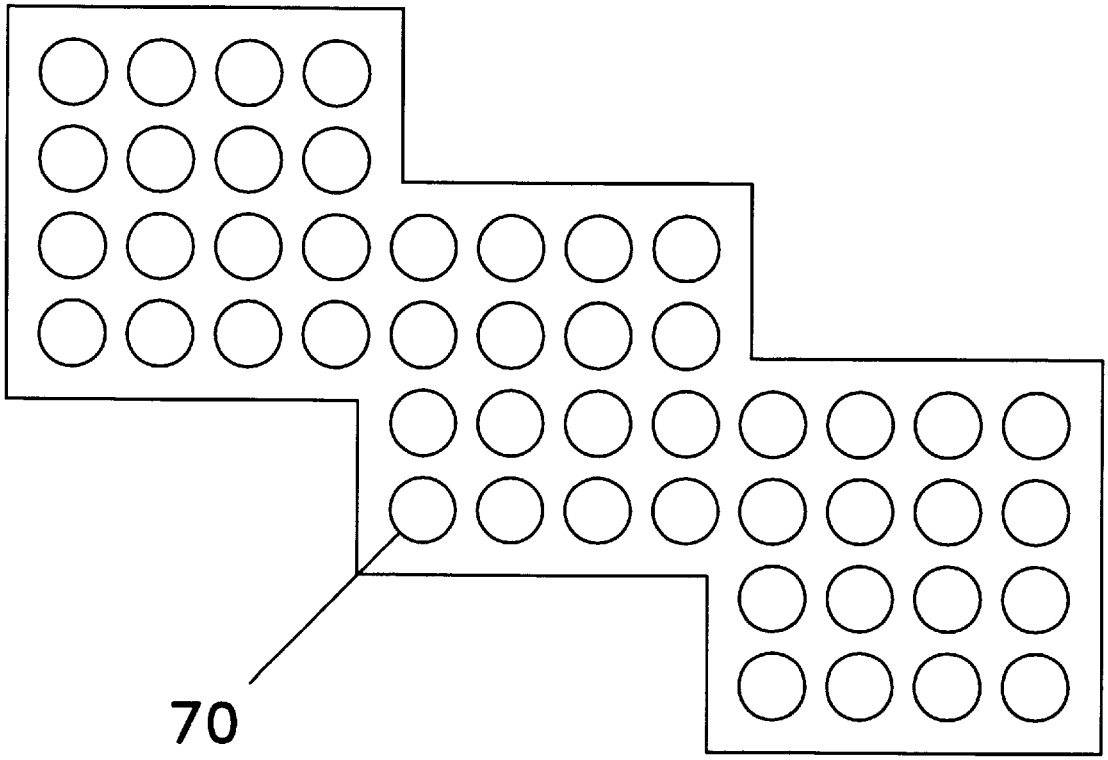
FIG. 15 is a plan view of Embodiment Two of the game base.
Figure 16:
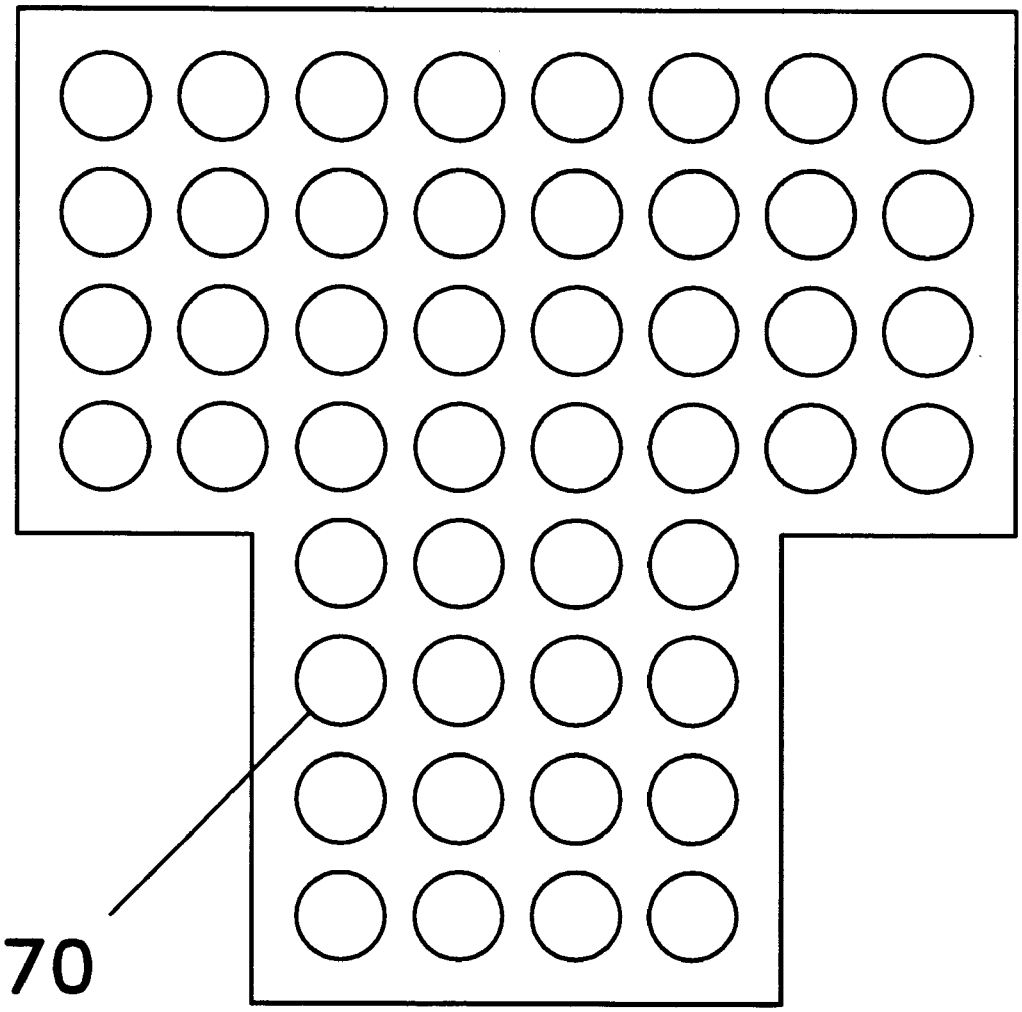
FIG. 16 is a plan view of Embodiment Three of the game base.

FIG. 15; Embodiment Two, and FIG. 16; Embodiment Three, of the game base 10 show alternate grids 80 that may be used. The quantity of said game pieces 150 used change according to the design of the three-dimensional structure 20. The three-dimensional structure is established by the grid 80 within the game base 10. Along with other alternate embodiments of the game base 10 which utilize alternate grids 80 than the grid 80 of the most preferred embodiment of the game base 10, said Embodiment Two of the game base 10 and said Embodiment Three of the game base 10, change the final design of the three-dimensional structure 20.

Figure 17:
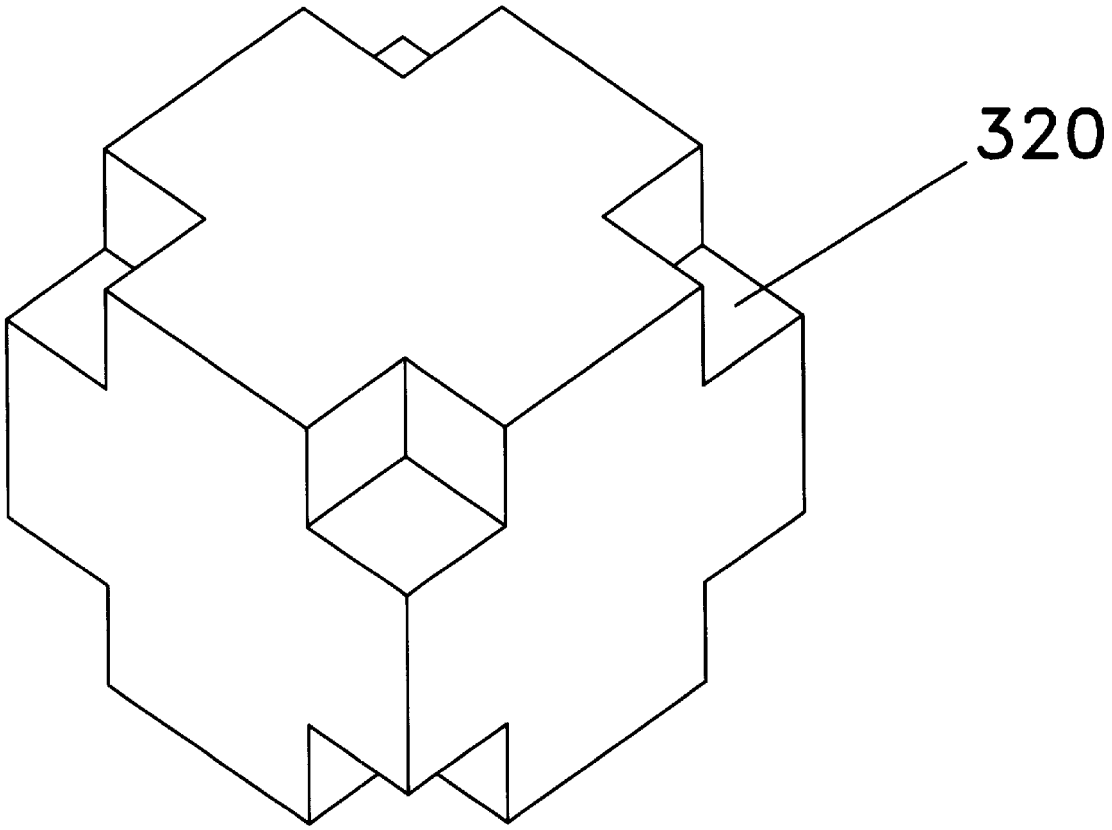
FIG. 17 is an isometric view of Embodiment Two of the game piece.

FIG. 17 shows Embodiment Two of the game piece 150. Said Embodiment Two of the game piece 150 is derived from a cubic structure. Said Embodiment Two of the game piece 150 is comprised of a void 320 at each comer of the cube. The void 320 acts as one comer of an alternate embodiment of a secondary means for holding a game piece 190.

Alternate embodiments of the method for playing the game may be used.

Figure 18:
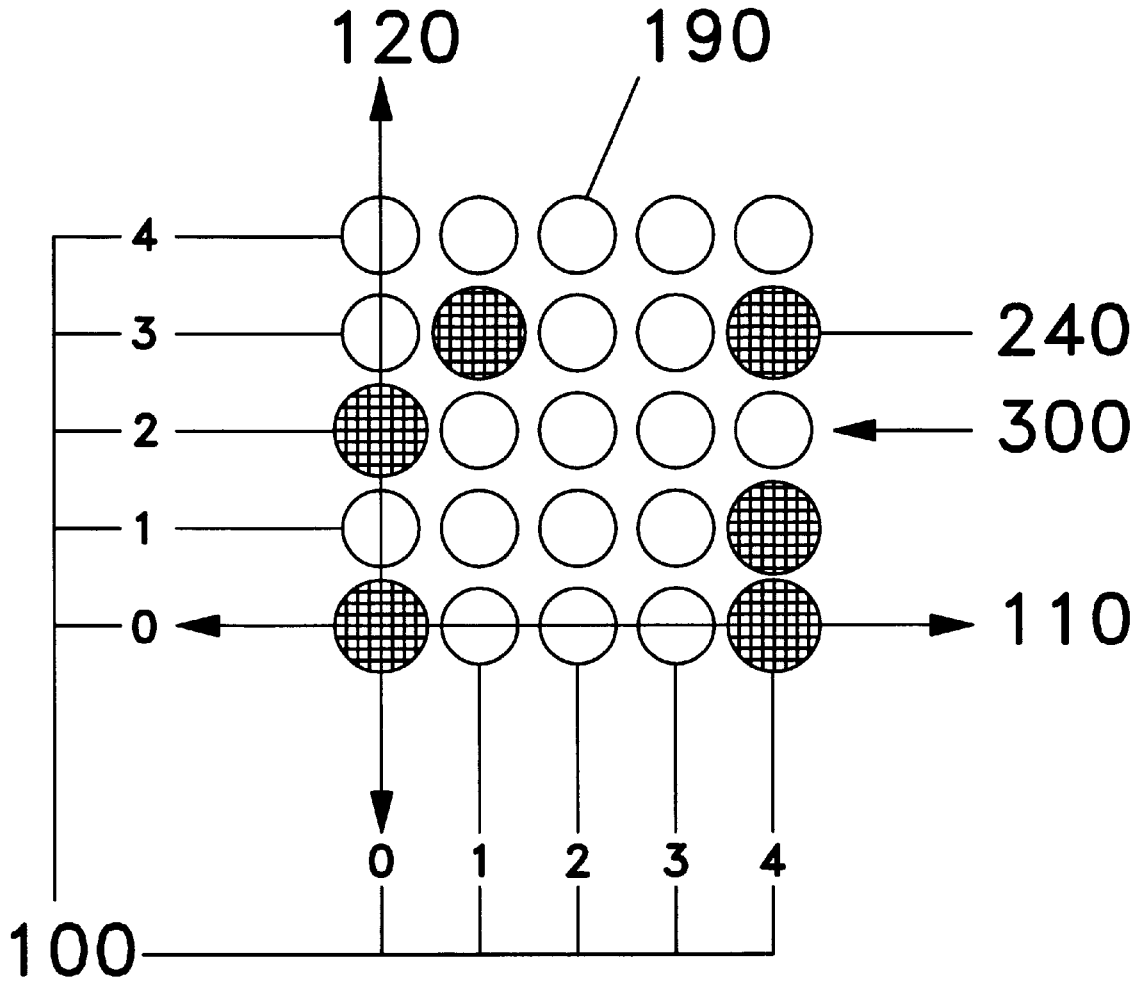
FIG. 18 is a schematic plan view of a planar level illustrating the adjacency step.
Figure 19:
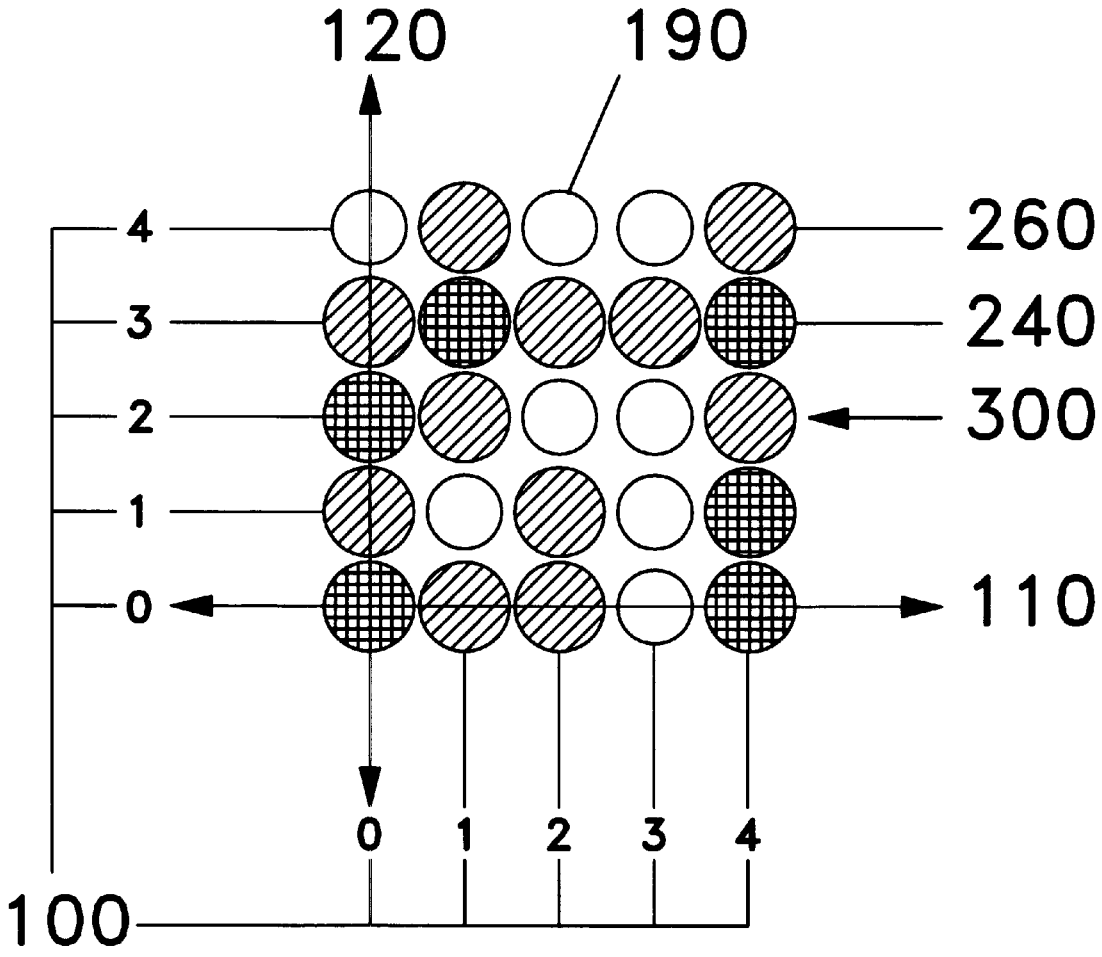
FIG. 19 is a schematic plan view of a planar level illustrating the adjacency step.

FIG. 18 and FIG. 19, schematic plan views of a planar level 300, illustrate Embodiment Two of the method for playing the game. In Embodiment Two of the method for playing the game said process for playing the game, of the most preferred embodiment, further comprises an adjacency step, comprising:

When the plurality of sets, excluding the free placement set, is greater than four, the game piece 150 of a set, excluding the game piece 150 of the free placement set, may not be placed in the primary means for holding a game piece 150 or the secondary means for holding a game piece 190, of the same said planar level 300, which has the same x-coordinate plus or minus one integer with a y-coordinate plus or minus one integer, as the primary means for holding a game piece 70 or the secondary means for holding a game piece 190 which is holding the game piece 150 of a set primarily controlled by another player, when the sequential order of distribution, during the process for setting up the game, of the set to which the game piece 150 being placed is a member of is identical to the set to which the game piece 150 limiting the placement of said game piece 150 being placed is a member.

FIG. 18 shows said game pieces 150 of the color black 240 placed randomly on a planar level 300. The coordinates of said game pieces 150 of the color black 240 placed randomly on said planar level are (0,0), (0,2), (1,3), (4,0), (4,1), and (4,3). Game pieces 150 of the color brown 260 are used to illustrate said adjacency step. In keeping with said adjacency step of Embodiment Two of the method for playing the game, FIG. 19 shows said secondary means for holding a game piece 190 within said planar level 300 where said game pieces 150 of the color brown 260 may not be placed. The coordinates of said secondary means for holding a game piece 190 where said game pieces 150 of the color brown 260 may not be placed are (0,4), (1,1), (2,2), (2,4), (3,0), (3,1), (3,2), and (3,4). In FIG. 19, all other said secondary means for holding a game piece 190 are shown holding a game piece 150 of the color brown 260.

When the player is unable to place a game piece 150, due to said adjacency step, said player's turn is skipped.

When none of the players are able to place a game piece 150, due to said adjacency step, play of the game ends.

During said process for determining a winner two times the value of any remaining game piece 150 is deducted from the player primarily controlling said game piece 150.

Figure 20:
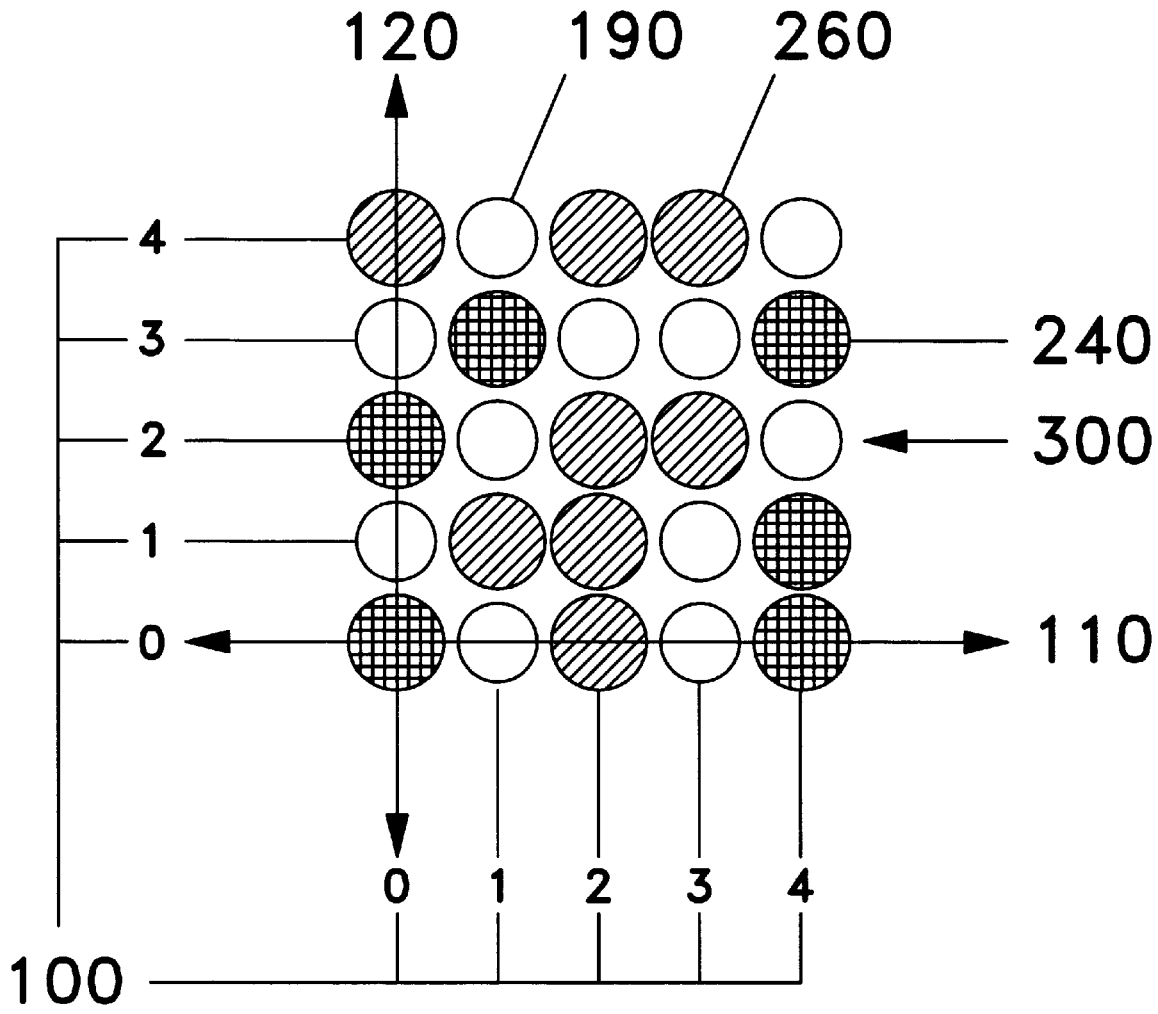
FIG. 20 is a schematic plan view of a planar level illustrating the adjacency step.

FIG. 18 and FIG. 20, schematic plan views of a planar level 300, illustrate Embodiment Three of the method for playing the game. In Embodiment Three of the method for playing the game said process for playing the game, of the most preferred embodiment, further comprises an adjacency step, comprising:

When the plurality of sets, excluding the free placement set, is greater than four, the game piece 150 of a set, excluding the game piece 150 of the free placement set, may not be placed in the primary means for holding a game piece 70 or the secondary means for holding a game piece 190, of the same said planar level 300, which has the same x-coordinate with a y-coordinate plus or minus one integer, or an x-coordinate plus or minus one integer with the same y-coordinate, as the primary means for holding a game piece 70 or the secondary means for holding a game piece 190 which is holding the game piece 150 of a set primarily controlled by another player, when the sequential order of distribution, during the process for setting Lip the game, of the set to which the game piece 150 being placed is a member of is identical to the set to which the game piece 150 limiting the placement of said game piece 150 being placed is a member.

In keeping with said adjacency step of Embodiment Three of the method for playing the game, FIG. 20 shows said secondary means for holding a game piece 190 within said planar level 300 where said game pieces 150 of the color brown 260 may not be placed. T he coordinates of said secondary means for holding a game piece 190 where said game pieces 150 of the color brown 260 may not be placed are (0,1), (0,3), (1,0), (1,2), (1,4), (2,3), (3,0), (3,1), (3,3), (4,2), and (4,4). In FIG. 20, all other said secondary means for holding a game piece 190 are shown holding a game piece 150 of the color brown 260.

When the player is unable to place a game piece 150, due to said adjacency step, said player's turn is skipped.

When none of the players are able to place a game piece 150, due to said adjacency step, play of the game ends.

During said process for determining a winner two times the value of any remaining game piece 150 is deducted from the player primarily controlling said game piece 150.

In yet another embodiment, Embodiment Four of the method for playing the game, said another player, of said adjacency step of Embodiment Two of the method for playing the game or said another player of said adjacency step of Embodiment Three of the method for playing the game, is positioned immediately adjacent and counter clockwise to said player placing the game piece 150.

Figure 21:
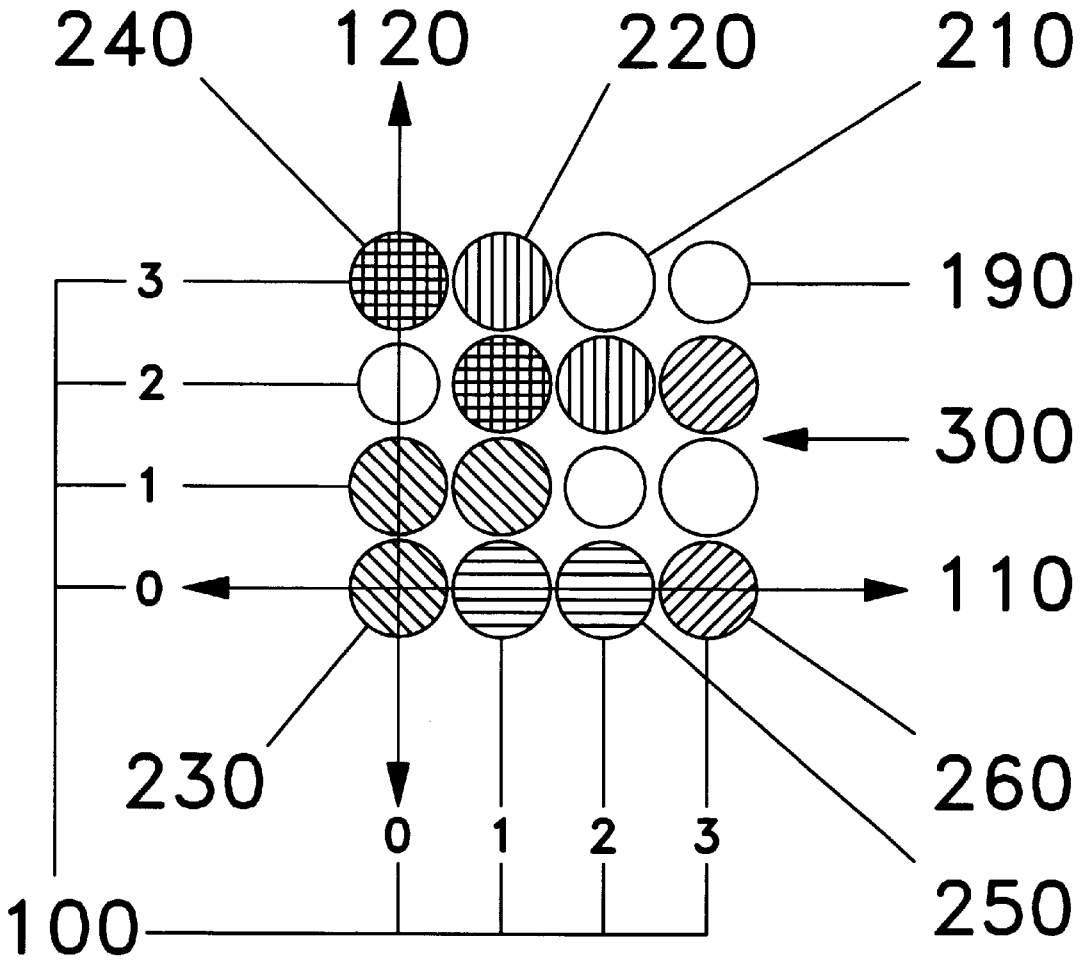
FIG. 21 is a schematic plan view of a planar level illustrating the removal and replacement step.
Figure 22:
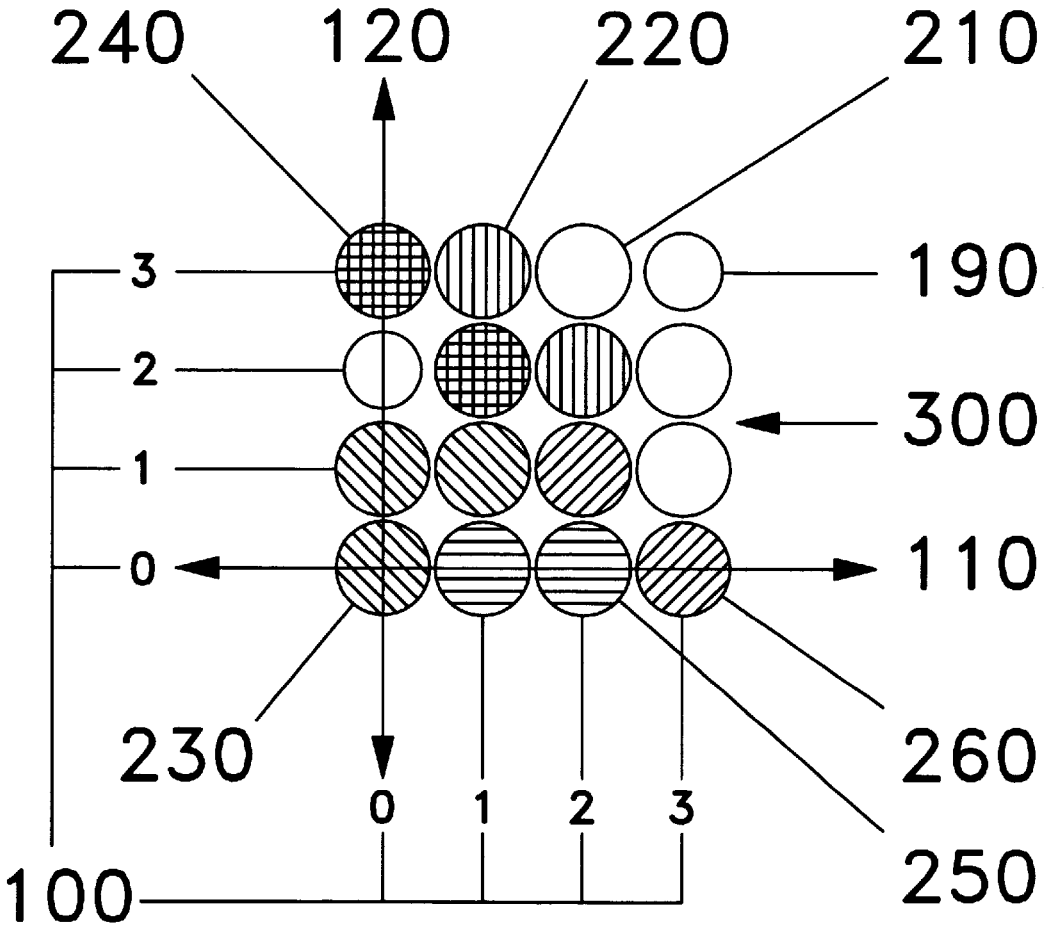
FIG. 22 is a schematic plan view of a planar level illustrating the removal and replacement step.

FIG. 21 and FIG. 22, schematic plan views of a planar level 300, illustrate Embodiment Five of the method for playing the game. In Embodiment Five of the method for playing the game said process for playing the game, of the most preferred embodiment, further comprises a removal and replacement, comprising:

When the plurality of sets, excluding the free placement set, is greater than two, players have the option of removing a game piece 150, primarily controlled by another player, from the three-dimensional structure and then placing said removed game piece 150 in any vacant said primary means for holding a game piece 70 or any vacant said secondary means for holding a game piece 190 of the planar levels 300.

The removal of the game piece 150 is predetermined by a set primarily controlled by the player removing the game piece 150. A game piece 150 of the set which predetermines the removal of said game piece 150 must be available for placement.

The game piece 150 of the set which predetermined the removal of said game piece 150 is replaced to the primary means for holding a game piece 70 or the secondary means for holding a game piece 190 from which said game piece 150 was removed.

Said free placement step is disregarded when the removal and replacement step is applied.

FIG. 21 shows said game pieces 150 of the color white 210, the color red 220, the color green 230, the color black 240, the color blue 250, and the color brown 260 placed randomly on a planar level 300. The coordinates of said game pieces 150 placed randomly on said planar level 300 are: the color white 210; (2,3) and (3,1), the color red 220; (1,3) and (2,2), the color green 230; (0,0), (0,1) and (1,1), the color black 240; (0,3) and (1,2), the color blue 250; (1,0) and (2,0), and the color brown 260; (3,0) and (3,2). The coordinates of vacant said secondary means for holding a game piece 190 are (0,2), (2,1), and (3,3). A game piece 150 of the color white 210 is used to illustrate said removal and replacement step. In keeping with said removal and replacement step of Embodiment Five of the method for playing the game, FIG. 22 shows that the player, primarily controlling the game piece 150 of the color white 210, removed a game piece 150 of the color brown 260 from coordinate (3,2) and then placed said removed game piece 150 of the color brown 260 in the vacant said secondary means for holding a game piece 190 located at coordinate (2,1) of the same said planar level 300.

The game piece 150 of the color white 210, which predetermined the removal of said game piece 150 of the color brown 260, is replaced to the secondary means for holding a game piece 190, located at coordinate (3,2), from which said game piece 150 of the color brown 260 was removed.

In still a further embodiment, Embodiment Six of the method for playing the game, said removal of said game piece 150 is predetermined by a set primarily controlled by the player removing said game piece 150 wherein the sequential order of distribution, during the process for setting up the game, of the set to which the game piece 150 being removed is a member of is identical to the set which predetermines the removal of said game piece 150.

In still a further embodiment, Embodiment Seven of the method for playing the game, said removal of said game piece 150 is predetermined by a set primarily controlled by the player removing said game piece 150 wherein the sequential order of distribution, during the process for setting up the game, of the set to which the game piece 150 being removed is a member is opposite to the set which predetermines the removal of said game piece 150.

In still a further embodiment, Embodiment Eight of the method for playing the game, said another player of said removal and replacement step of Embodiment Five of the method for playing the game, Embodiment Six of the method for playing the game, or Embodiment Seven of the method for playing the game is positioned immediately adjacent and clockwise to said player having the option of removing said game piece 150.

In yet a further embodiment, Embodiment Nine of the method for playing the game, said process for determining a winner of the game further comprises a multiplication by sides step, comprising:

Before points are tallied, the quantity of sides of said three-dimensional structure 20 with which the game piece 150 is in communication is multiplied by said point value of said game piece 150.

In yet a further embodiment, Embodiment Ten of the method for playing the game, said process for determining a winner of the game further comprises a multiplication by planar level step, comprising:

Before points are tallied, the point value of the game piece 150 is multiplied by the planar level 300 with which said game piece 150 resides.

The preceding detailed description of the embodied Multi-Dimensional Stacking Game invention, including all forms of the game apparatus and methods of play have been presented for the purpose of description and illustration. This detailed description is not intended to be exhaustive or to confine the invention to the precise form disclosed. Many modifications and variations are possible in light of the above teaching. It is intended that the scope of the invention be limited not by this detailed description or alternate descriptions, but rather by the claims appended hereto.

What is claimed is:

1. An apparatus for playing a game for two to eight players comprising:

(a) a game base comprising:

(b) a top plane, (c) a bottom plane;

(d) the bottom plane is parallel to the top plane, (e) a plurality of side planes;

(f) the plurality of side planes connect the top plane to the bottom plane, (g) at least sixteen primary means for holding a game piece;

(h) each said primary means for holding a game piece is in communication with the top plane, (i) the arrangement of the primary means for holding a game piece, in communication with the top plane of the game base, forms (j) a grid;

(k) the grid is defined by a "Cartesian coordinate system" which uses integers on the x-axis number line and the y-axis number line of the "Cartesian coordinate system" to specify the coordinates within the "Cartesian coordinate system;"

(l) the distance between each said integer on the x-axis number line and the y-axis number line is identical, (m) within the grid, the center of each said primary means for holding a game piece is located at a coordinate point, (n) within the grid, each said primary means for holding a game piece is part of an uninterrupted sequence of at least four said primary means for holding a game piece, wherein;

(o) each said primary means for holding a game piece has the same x-coordinate, also (p) the primary means for holding a game piece have successive y-coordinates, (q) furthermore, within the grid, each said primary means for holding a game piece is part of an uninterrupted sequence of at least four said primary means for holding a game piece wherein;

(r) the primary means for holding a game piece have successive x-coordinates, also (s) each said primary means for holding a game piece each has the same y-coordinate, (t) within the grid, each said primary means for holding a game piece is part of (u) a group;

(v) each said group consists of four said primary means for holding a game piece, positioned in the shape of a square, (w) within the group, each said primary means for holding a game piece is adjacent to two primary means for holding a game piece wherein one of the adjacent primary means for holding a game piece has the same x-coordinate with a successive y-coordinate and the other adjacent primary means for holding a game piece has a successive x-coordinate with the same y-coordinate, as said primary means for holding a game piece, (x) furthermore, each said primary means for holding a game piece is distant from the primary means for holding a game piece to which said primary means for holding a game piece is adjacent, such that the game piece, which is held by said primary means for holding a game piece, does not obstruct the game piece which is held by the primary means for holding a game piece to which said primary means for holding a game is adjacent, (y) also, each said primary means for holding a game piece is near to the primary means for holding a game piece to which said primary means for holding a game piece is adjacent, such that when each primary means for holding a game piece of the group is holding a game piece simultaneously, the four said game pieces collectively create a secondary means for holding a game piece;

(z) the secondary means for holding a game piece supports a game piece in a manner that positions the game piece above the top plane of the game base and centered above, and tangent to, at least the four said game pieces that support the game piece, (aa) within the grid, each said group is positioned adjacent to between two and four other said groups, such that within each said group, two said primary means for holding a game piece, which are adjacent, are members of the adjacent said group, (ab) the grid is the sum of the adjacent said groups, (ac) at least thirty game pieces, comprising:

(ad) enough said game pieces to entirely build a three-dimensional structure, with no vacant said primary means for holding a game piece and no vacant said secondary means for holding a game piece, (ae) the game pieces are all identical in size and shape;

(af) the size and shape enables each said game piece to be held by each said primary means for holding a game piece and each said secondary means for holding a game piece, (ag) the game pieces are partitioned into (ah) a plurality of sets;

(ai) the plurality of sets is at least equal to the number of players playing the game and no greater than ten, (aj) each said game piece is a member of a set, (ak) the quotient, from the game pieces divided by the plurality of sets, defines the quantity of said game pieces that are in each said set;

(al) any said game pieces remaining from said division are members of a remainder set, (am) the quotient, from the plurality of sets divided by the quantity of players, defines the quantity of said sets, other than a free placement set, that each player primarily controls throughout the game;

(an) any said sets remaining from said division are members of the free placement set, (ao) the quotient, from the quantity of said game pieces of the free placement set divided by the quantity of players, defines the quantity of said game pieces of the free placement set that each player primarily controls throughout the game;

(ap) any said game pieces remaining from said division are members of the remainder set, (aq) each said game piece is comprised of at least one distinguishing feature;

(ar) each said game piece of a set has the same said distinguishing feature, (as) each said game piece of a set has a distinguishing feature that is different from the game pieces the other said sets, (at) the distinguishing feature enables players to rapidly differentiate the game pieces of one said set with the game pieces of the other said sets, (au) each said game piece, other than the game pieces of the remainder set and the free placement set, has (av) a point value;

(aw) the point value is identical for all said game pieces of a set, (ax) the point value is determined by the order of distribution of the set to the player during the process for setting up the game, wherein;

(ay) each said game piece of the first said set distributed to the player has a point value;

(az) said point value is identical for each said game piece of all first said sets distributed to the players, (ba) each said game piece of the second said set distributed to the player has a point value from three to five times greater than the point value of each said game piece of the first said set distributed to the player;

(bb) said point value is identical for each said game piece of all second said sets distributed to the players, (bc) each said game piece of the third said set distributed to the player has a point value from two to three times greater than the point value of each said game piece of the second said set distributed to the player;

(bd) said point value is identical for each said game piece of all third said sets distributed to the players, (be) the point value of each said game piece of each additional said set, greater than the third said set, distributed to the player is two times greater than the point value of each said game piece of the previous said set distributed to the player, (bf) at least four planar levels, formed from the stacking of said game pieces throughout the game, comprising:

(bg) a planar level is the sum of the game pieces, supported by the primary means for holding a game piece or the secondary means for holding a game piece, within the same horizontal plane parallel to the top plane of the game base, (bh) each said planar level builds upon the planar level below said planar level, (bi) the "Cartesian coordinate system" is used to specify the coordinates of the secondary means for holding a game piece within each said planar level above the planar level tangent to the top plane of the game base;

(bj) the use of the "Cartesian coordinate system," within a planar level, is independent from all other said planar levels, (bk) a plurality of containers, comprising:

(bl) the plurality of containers is equal to the quantity of said sets distributed to the players, (bm) each said container is large enough to contain all of the game pieces of a set.

2. The apparatus for playing the game of claim 1 wherein said top plane, said bottom plane, and said plurality of side planes are each in the form of a parallelogram.

3. The apparatus for playing the game of claim 2 wherein said game base further comprises:

(bn) a plurality of angular planes;

(bo) each said angular plane is angular to the top plane and to each said side plane, (bp) the plurality of angular planes are in communication with the top plane and the plurality of side planes.

4. The apparatus for playing the game of claim 3 wherein said plurality of angular planes are each in the form of a trapezoid.

5. The apparatus for playing the game of claim 1 wherein each said primary means for holding a game piece is comprised of a hemispherically shaped cavity recessed into said game base.

6. The apparatus for playing the game of claim 5, wherein; when said game piece is held by said primary means for holding a game piece the entire surface of said hemispherically shaped cavity is in communication with said game piece.

7. The apparatus for playing the game of claim 1 wherein said primary means for holding a game piece, within said grid, are arranged wherein:

(bq) each said primary means for holding a game piece is part of an uninterrupted sequence of eight said primary means for holding a game piece;

(br) each said primary means for holding a game piece has the same x-coordinate, also (bs) said primary means for holding a game piece have successive y-coordinates, (bt) each said primary means for holding a game piece is part of an uninterrupted sequence of eight said primary means for holding a game piece;

(bu) said primary means for holding a game piece have successive x-coordinates, also (bv) each said primary means for holding a game piece has the same y-coordinate.

8. The apparatus for playing the game of claim 7, wherein:

(bw) when there are two, three, or six players playing the game there are (bx) two hundred and four said game pieces partitioned into (by) six said sets;

(bz) each said set containing thirty four said game pieces, (ca) when there are four players playing the game there are (cb) two hundred and four said game pieces partitioned into (cc) five said sets;

(cd) four said sets, each said set containing thirty four said game pieces and (ce) one said free placement set containing sixty eight said game pieces, (cf) when there are five players playing the game there are (cg) two hundred and four said game pieces partitioned into (ch) seven said sets;

(ci) five said sets, each said set containing thirty four said game pieces, (cj) one free placement set containing thirty said game pieces, and (ck) one remainder set containing four said game pieces, (cl) when there are seven players playing the game there are (cm) two hundred and four said game pieces partitioned into (cn) eight said sets;

(co) seven said sets, each said set containing twenty nine said game pieces and (cp) one remainder set containing one said game piece, (cq) when there are eight players playing the game there are (cr) two hundred and four said game pieces partitioned into (cs) nine said sets;

(ct) eight said sets, each said set containing twenty five said game pieces and (cu) one said remainder set containing four said game pieces.

9. The apparatus for playing the game of claims 1, 5, or 6 wherein the shape of said game piece is comprised of a sphere.

10. The apparatus for playing the game of claim 1 wherein said distinguishing feature comprises a color.

11. The apparatus for playing the game of claim 10 wherein said color is white, red, green, black, blue, brown, yellow, purple, or orange.

12. A method for playing a game for two to eight players comprising:

($a_0$) providing an apparatus for playing the game comprising:

(a) a game base, comprising:

(b) a top plane, (c) a bottom plane;

(d) the bottom plane is parallel to the top plane, (e) a plurality of side planes;

(f) the plurality of side planes connect the top plane to the bottom plane, (g) at least sixteen primary means for holding a game piece;

(h) each said primary means for holding a game piece is in communication with the top plane, (i) the arrangement of the primary means for holding a game piece, in communication with the top plane of the game base, forms (j) a grid;

(k) the grid is defined by a "Cartesian coordinate system" which uses integers on the x-axis number line and the y-axis number line of the "Cartesian coordinate system" to specify the coordinates within the "Cartesian coordinate system;"

(l) the distance between each said integer on the x-axis number line and the y-axis number line is identical, (m) within the grid, the center of each said primary means for holding a game piece is located at a coordinate point, (n) within the grid, each said primary means for holding a game piece is part of an uninterrupted sequence of at least four said primary means for holding a game piece, wherein;

(o) each said primary means for holding a game piece has the same x-coordinate, also (p) the primary means for holding a game piece have successive y-coordinates.

(q) furthermore, within the grid, each said primary means for holding a game piece is part of an uninterrupted sequence of at least four said primary means for holding a game piece, wherein;

(r) the primary means for holding a game piece have successive x-coordinates, also (s) each said primary means for holding a game piece each has the same y-coordinate, (t) within the grid, each said primary means for holding a game piece is part of (u) a group;

(v) each said group consists of four said primary means for holding a game piece, positioned in the shape of a square, (w) within the group, each said primary means for holding a game piece is adjacent to two primary means for holding a game piece wherein one of the adjacent primary means for holding a game piece has the same x-coordinate with a successive y-coordinate and the other adjacent primary means for holding a game piece has a successive x-coordinate with the same y-coordinate, as said primary means for holding a game piece, (x) furthermore, each said primary means for holding a game piece is distant from the primary means for holding a game piece to which said primary means for holding a game piece is adjacent, such that the game piece, which is held by said primary means for holding a game piece, does not obstruct the game piece which is held by the primary means for holding a game piece to which said primary means for holding a game is adjacent, (y) also, each said primary means for holding a game piece is near to the primary means for holding a game piece to which said primary means for holding a game piece is adjacent, such that when each primary means for holding a game piece of the group is holding a game piece simultaneously, the four said game pieces collectively create a secondary means for holding a game piece;

(z) the secondary means for holding a game piece supports a game piece in a manner that positions the game piece above the top plane of the game base and centered above, and tangent to, at least the four said game pieces that support the game piece, (aa) within the grid, each said group is positioned adjacent to between two and four other said groups, such that within each said group, two said primary means for holding a game piece, which are adjacent, are members of the adjacent said group, (ab) the grid is the sum of the adjacent said groups, (ac) at least thirty game pieces, comprising:

(ad) enough said game pieces to entirely build a three-dimensional structure, with no vacant said primary means for holding a game piece and no vacant said secondary means for holding a game piece, (ae) the game pieces are all identical in size and shape;

(af) the size and shape enables each said game piece to be held by each said primary means for holding a game piece and each said secondary means for holding a game piece, (ag) the game pieces are partitioned into (ah) a plurality of sets;

(ai) the plurality of sets is at least equal to the number of players playing the game and no greater than ten, (aj) each said game piece is a member of a set, (ak) the quotient, from the game pieces divided by the plurality of sets, defines the quantity of said game pieces that are in each said set;

(al) any said game pieces remaining from said division are members of a remainder set, (am) the quotient, from the plurality of sets divided by the quantity of players, defines the quantity of said sets, other than a free placement set, that each player primarily controls throughout the game;

(an) any said sets remaining from said division are members of the free placement set, (ao) the quotient, from the quantity of said game pieces of the free placement set divided by the quantity of players, defines the quantity of said game pieces of the free placement set that each player primarily controls throughout the game;

(ap) any said game pieces remaining from said division are members of the remainder set, (aq) each said game piece is comprised of at least one distinguishing feature;

(ar) each said game piece of a set has the same said distinguishing feature, (as) each said game piece of a set has a distinguishing feature that is different from the game pieces the other said sets, (at) the distinguishing feature enables players to rapidly differentiate the game pieces of one said set with the game pieces of the other said sets, (au) each said game piece, other than the game pieces of the remainder set and the free placement set, has (av) a point value;

(aw) the point value is identical for all said game pieces of a set, (ax) the point value is determined by the order of distribution of the set to the player during the process for setting up the game, wherein;

(ay) each said game piece of the first said set distributed to the player has a point value;

(az) said point value is identical for each said game piece of all first said sets distributed to the players, (ba) each said game piece of the second said set distributed to the player has a point value from three to five times greater than the point value of each said game piece of the first said set distributed to the player;

(bb) said point value is identical for each said game piece of all second said sets distributed to the players, (bc) each said game piece of the third said set distributed to the player has a point value from two to three times greater than the point value of each said game piece of the second said set distributed to the player;

(bd) said point value is identical for each said game piece of all third said sets distributed to the players, (be) the point value of each said game piece of each additional said set, greater than the third said set, distributed to the player is two times greater than the point value of each said game piece of the previous said set distributed to the player, (bf) at least four planar levels, formed from the stacking of said game pieces throughout the game, comprising:

(bg) a planar level is the sum of the game pieces, supported by the primary means for holding a game piece or the secondary means for holding a game piece, within the same horizontal plane parallel to the top plane of the game base, (bh) each said planar level builds upon the planar level below said planar level, (bi) the "Cartesian coordinate system" is used to specify the coordinates of the secondary means for holding a game piece within each said planar level above the planar level tangent to the top plane of the game base;

(bj) the use of the "Cartesian coordinate system," within a planar level, is independent from all other said planar levels, (bk) a plurality of containers, comprising:

(bl) the plurality of containers is equal to the quantity of said sets distributed to the players, (bm) each said container is large enough to contain all of the game pieces of a set, (bn) a process for setting up the game, comprising:

(bo) collecting the game pieces together into the plurality of sets, (bp) placing each said set, other than the remainder set, into a separate said container;

(bq) when the free placement sets are available, placing the free placement set primarily controlled by each player into a separate said container, (br) distributing the sets to the players, wherein;

(bs) each player receives one said set at a time, rotating among all of the players, until all said sets are distributed;

(bt) distributing available said free placement sets to the players wherein each player receives one said free placement set, (bu) positioning players around the game base in a clockwise direction;

(bv) these positions are sequential according to the order of distribution of the first said set distributed to the players, (bw) placing the remainder set in the primary means for holding a game piece most centrally located within the grid;

(bx) the remainder set must be placed away from the visible, outer, surface of the three-dimensional structure, (by) a process for playing the game, comprising:

(bz) randomly selecting one of the game pieces of the sets;

(ca) the random selection is to be made from said sets other than the remainder set and the free placement sets, (cb) the player primarily controlling the game piece of the set selected beginning play of the game, by (cc) taking a turn, comprising;

(cd) having the option of placing a game piece of the free placement set at the beginning of the turn, wherein;

(ce) the option of placing a game piece of the free placement set may only be applied when said free placement sets have been distributed to the players during the process for setting up the game, (cf) when a game piece of the free placement set is placed another game piece, of the free placement set, or of the set or sets other than the free placement set, must be placed in the same turn, (cg) when a game piece, of the set or sets other than the free placement set, is placed, the turn ends, (ch) following the placement of the last said game piece of the free placement set a game piece of the other said set or sets primarily controlled by said player must be placed, if one is available;

(ci) the turn then ends, or (cj) placing a game piece of the said set or said sets, other than the free placement set, primarily controlled said player in any vacant said primary means for holding a game piece or any said vacant secondary means for holding a game piece, (ck) rotating turns clockwise throughout the entire game, (cl) obtaining points through the placement of the game pieces on the visible, outer, surface of the three-dimensional structure, (cm) continuing play until all of the game pieces that can be placed are placed, (cn) if possible, completing the three-dimensional structure, (co) ending play of the game, (cp) a process for determining a winner of the game comprising:

(cq) tallying points earned by adding up the values of the game pieces on the visible, outer, surface of the three-dimensional structure, (cr) determining a winner of the game;

(cs) the player with the greatest quantity of points from the tally wins the game, (ct) if the quantity of points earned by a player is equal to the quantity of points earned by another player then the game is a tie.

13. The method for playing the game of claim 12, wherein said process for playing the game further comprises:

(cv) an adjacency step, comprising;

(cw) when the plurality of sets, excluding the free placement set, is greater than four, not placing the game piece of a set, excluding the game piece of the free placement set, in the primary means for holding a game piece or the secondary means for holding a game piece, of the same said planar level, which has the same x-coordinate plus or minus one integer with a y-coordinate plus or minus one integer, as the primary means for holding a game piece or the secondary means for holding a game piece which is holding the game piece of a set primarily controlled by another player, when the sequential order of distribution, during the process for setting up the game, of the set to which the game piece being placed is a member of is identical to the set to which the game piece limiting the placement of said game piece being placed is a member, (cx) skipping said turn when the player is unable to place a game piece, due to the adjacency step, (cy) ending play of the game when none of the players are able to place a game piece, due to the adjacency step;

(cz) during the process for determining a winner deducting two times the value of any remaining game piece from the player primarily controlling said game piece.

14. The method for playing the game of claim 12, wherein said process for playing the game further comprises:

(da) an adjacency step comprising;

(db) when the plurality of sets, excluding the free placement set, is greater than four. not placing the game piece of a set, excluding the game piece of the free placement set, in the primary means for holding a game piece or the secondary means for holding a game piece, of the same said planar level, which has the same x-coordinate with a y-coordinate plus or minus one integer, or an x-coordinate plus or minus one integer with the same y-coordinate, as the primary means for holding a game piece or the secondary means for holding a game piece which is holding the game piece of a set primarily controlled by another player, when the sequential order of distribution, during the process for setting up the game, of the set to which the game piece being placed is a member of is identical to the set to which the game piece limiting the placement of said game piece being placed is a member, (dc) skipping said turn when the player is unable to place a game piece, due to the adjacency step, (de) ending the game when none of the players are able to place a game piece due, to the adjacency step;

(df) during said process for determining a winner deducting two times the value of any remaining game piece from the player primarily controlling said game piece.

15. The process for playing the game of claim 13 or claim 14, wherein said another player is positioned immediately adjacent and counter clockwise to said player placing the game piece.

16. The method for playing the game of claim 12, wherein said process for playing the game further comprises:

(dh) a removal and replacement step comprising:

(di) when the plurality of sets, excluding the free placement set, is greater than two, having the option of removing a game piece, primarily controlled by another player, from the three-dimensional structure and then placing said removed game piece in any vacant said primary means for holding a game piece or any vacant secondary said means for holding a game piece of the planar levels;

(dj) the removal of said game piece is predetermined by a set primarily controlled by the player removing the game piece;

(dk) a game piece of the set which predetermines the removal of said game piece must be available for placement, (dl) replacing the game piece of the set which predetermined the removal of said game piece to the primary means for holding a game piece or the secondary means for holding a game piece from which said game piece was removed, (dm) disregarding said free placement step when the removal and replacement step is applied.

17. The process for playing the game of claim 16, wherein said removal of said game piece is predetermined by a set primarily controlled by the player removing said game piece wherein the sequential order of distribution, during the process for setting up the game, of the set to which the game piece being removed is a member of is identical to the set which predetermines the removal of said game piece.

18. The process for playing the game of claim 16, wherein said removal of said game piece is predetermined by a set primarily controlled by the player removing said game piece wherein the sequential order of distribution, during the process for setting up the game, of the set to which the game piece being removed is a member of is opposite to the set which predetermines the removal of said game piece.

19. The process for playing the game of claims 16, 17, or 18, wherein said another player is positioned immediately adjacent and clockwise to said player having the option of removing said game piece.

20. The method for playing the game of claim 12, wherein said process for determining a winner of the game further comprises:

(dt) a multiplication by sides step comprising:

(du) before tallying points, multiplying the quantity of sides of said three-dimensional structure with which the game piece is in communication by said point value of said game piece.

21. The method for playing the game of claim 12 or claim 20, wherein said process for determining a winner of the game further comprises:

(dv) a multiplication by planar level step comprising:

(dw) before tallying points, multiplying the point value of the game piece by the planar level with which said game piece resides.

* * * * *